US007255765B2

(12) United States Patent
Ruggie et al.

(10) Patent No.: US 7,255,765 B2
(45) **Date of Patent: *Aug. 14, 2007**

(54) METHOD OF MAKING A COMPOSITE BUILDING MATERIAL

(75) Inventors: Mark A. Ruggie, Franklin Park, IL (US); Brian Bonomo, Oak Park, IL (US); Lemuel Lee Braddock, Huntley, IL (US); Toplica Koledin, Darien, IL (US); Bei-Hong Liang, Naperville, IL (US); Steven K. Lynch, St. Charles, IL (US); Kathleen Nemivant, Forest Park, IL (US); Beverly Pearce, Winchester, IL (US); Mark Allen Weldon, Elburn, IL (US)

(73) Assignee: Masonite Corporation, Tampa, FL (US)

( * ) Notice: Subject to any disclaimer, the term of this patent is extended or adjusted under 35 U.S.C. 154(b) by 73 days.

This patent is subject to a terminal disclaimer.

(21) Appl. No.: 10/913,525

(22) Filed: Aug. 9, 2004

(65) Prior Publication Data

US 2005/0011605 A1 Jan. 20, 2005

Related U.S. Application Data

(60) Division of application No. 09/680,115, filed on Oct. 5, 2000, now Pat. No. 6,773,791, which is a continuation-in-part of application No. 09/538,766, filed on Mar. 30, 2000, now Pat. No. 6,511,567.

(60) Provisional application No. 60/127,120, filed on Mar. 31, 1999.

(51) Int. Cl.
*B32B 5/02* (2006.01)
*B32B 3/30* (2006.01)

(52) U.S. Cl. ..... 156/210; 156/242; 156/292

(58) Field of Classification Search ..... None
See application file for complete search history.

(56) References Cited

U.S. PATENT DOCUMENTS 2,627,484 A 2/1953 Brown
2,717,420 A 9/1955 Roy (Continued)

FOREIGN PATENT DOCUMENTS

CA 2175865 11/1997

(Continued)

OTHER PUBLICATIONS

Koch et al., "Shaped Lathe Headrig Yields Sold and Molded Flake Hardwood Products," Forest Products Journal (1978), vol. 28, No. 10, pp. 53-61.

(Continued)

*Primary Examiner*—Richard Crispino
*Assistant Examiner*—Barbara J Musser
(74) *Attorney, Agent, or Firm*—Berenato, White & Stavish

(57) ABSTRACT

A composite building component includes a non-planar molded composite web having two outer zones and two angled zones wherein the caliper of the angled zones differs from the caliper of at least one of the outer zones, and a flange disposed on an outer surface of an outer zone. A method of providing a composite building component also is disclosed.

26 Claims, 7 Drawing Sheets

U.S. PATENT DOCUMENTS 3,061,878 A 11/1962 Chapman
3,179,983 A 4/1965 Webber et al.
3,354,248 A 11/1967 Haas et al.
3,359,929 A 12/1967 Carlson
3,423,267 A 1/1969 Munk
3,538,668 A 11/1970 Anderson
3,709,646 A 1/1973 Munk
3,720,176 A 3/1973 Munroe
3,764,654 A 10/1973 Munk
3,800,485 A 4/1974 Yates
3,810,798 A 5/1974 McCoy
3,844,231 A 10/1974 Peacock
3,861,326 A 1/1975 Brown
3,868,300 A 2/1975 Wheeler
3,884,749 A 5/1975 Pankoke
3,935,357 A 1/1976 Padovani
4,039,708 A 8/1977 Okada et al.
4,061,813 A * 12/1977 Geimer et al. ..... 428/183
4,073,851 A 2/1978 Munk
4,078,030 A 3/1978 Munk
4,084,996 A 4/1978 Wheeler
4,127,636 A 11/1978 Flanders
4,150,186 A 4/1979 Kazama
4,191,606 A 3/1980 Evans
4,195,462 A 4/1980 Keller et al.
4,221,751 A 9/1980 Haataja et al.
4,248,163 A * 2/1981 Caughey et al. ..... 108/53.3
4,248,820 A 2/1981 Haataja
4,347,019 A 8/1982 Metz
4,364,984 A 12/1982 Wentworth
4,378,265 A 3/1983 Kiss
4,387,546 A 6/1983 Kurita et al.
4,408,544 A 10/1983 Haataja
4,415,516 A 11/1983 Krueger et al.
4,428,791 A 1/1984 Reinke
4,429,012 A 1/1984 Danko
4,440,708 A 4/1984 Haataja et al.
4,514,532 A 4/1985 Hsu et al.
4,559,195 A 12/1985 Heggenstaller
4,610,900 A 9/1986 Nishibori
4,616,991 A 10/1986 Bach et al.
4,635,421 A 1/1987 Newberg
4,675,138 A 6/1987 Bach et al.
4,734,236 A 3/1988 Davis
4,790,966 A 12/1988 Sandberg et al.
4,828,643 A 5/1989 Newman et al.
4,830,929 A 5/1989 Ikeda et al.
4,843,777 A 7/1989 Shimabukuro
4,844,968 A 7/1989 Persson et al.
4,865,788 A 9/1989 Davis
4,904,517 A 2/1990 Lau et al.
4,923,656 A 5/1990 Held
4,960,553 A 10/1990 DeBruine et al.
5,000,673 A 3/1991 Bach et al.
5,028,371 A 7/1991 Bach
5,028,374 A 7/1991 Imao et al.
5,047,280 A 9/1991 Bach
5,067,536 A 11/1991 Liska et al.
5,142,994 A 9/1992 Sandberg et al.
5,144,785 A 9/1992 Berglund
5,164,255 A 11/1992 Weeks
5,198,236 A 3/1993 Gunderson et al.
5,210,990 A 5/1993 Kirk, Jr.
5,223,326 A 6/1993 Bach
5,242,735 A 9/1993 Blankenburg et al.
5,273,806 A 12/1993 Lockshaw et al.
5,290,621 A 3/1994 Bach et al.
5,299,691 A 4/1994 Winski
5,301,487 A 4/1994 Wiebe
5,302,455 A 4/1994 DePetris et al.
5,401,556 A 3/1995 Ishitoya et al.
5,435,954 A 7/1995 Wold
5,440,998 A 8/1995 Morgan, IV et al.
5,443,891 A 8/1995 Bach
5,471,806 A 12/1995 Rokhlin
5,543,234 A 8/1996 Lynch et al.
5,609,006 A 3/1997 Boyer
5,633,053 A 5/1997 Lockshaw et al.
5,653,080 A 8/1997 Bergeron
5,664,393 A 9/1997 Veilleux et al.
5,685,124 A 11/1997 Jandl, Jr.
5,766,774 A 6/1998 Lynch et al.
5,773,117 A 6/1998 Tognelli
5,850,721 A 12/1998 Martin
5,900,304 A * 5/1999 Owens ..... 428/182
6,364,982 B1 * 4/2002 Lynch et al. ..... 156/196

FOREIGN PATENT DOCUMENTS

DE 835 053 3/1952
EP 0 049 299 A1 * 4/1982
EP 49299 4/1982
EP 0049299 * 4/1982

OTHER PUBLICATIONS

McAlister, "Species and Core Joint Design Affect Tensile Strength and Stiffness of Composite Truss Lumber," Forest Products Journal (1986), vol. 36, No. 2, pp. 55-58.
Koenigshof, "Strength and Stiffness of Composite Floor Joists," Forest Products Journal (1989), vol. 39, No. 9, pp. 66-70.
Bach, "Manufacture of Corrugated Waferboard," Forest Products Journal (1989), vol. 39, No. 10, pp. 58-62.
Wavebord(TM) (Corrugated Waferboard) Business Opportunity Offer Document (1995), Alberta Research Council.
Bach et al, "An Innovative Stressed Skin Panel System Using Corrugated Waferboard," Canadian Society for Civil Engineering, Annual Conference (1995).
SIM STUD Product Bulletin 05-950.342, BIOS+ VALUE Inc., Mar. 1998.
International Search Report dated Mar. 10, 2000, in PCT/US99/26633.
International Search Report dated Jul. 13, 2000, in PCT/US00/08520.
Written Opinion dated Jul. 24, 2000, in PCT/US99/26633.

* cited by examiner

METHOD OF MAKING A COMPOSITE BUILDING MATERIAL

CROSS-REFERENCE TO RELATED APPLICATIONS

This application is a divisional of application Ser. No. 09/680,115, filed Oct. 5, 2000, now U.S. Pat. No. 6,773,791, which is a CIP of application Serial No. 09/538,766 filed Mar. 30, 2000, now U.S. Pat. No. 6,511, 567, which claims priority to provisional application Ser. No. 60/127,120 filed Mar. 31, 1999 the disclosure of which is incorporated herein by reference and priority to which is claimed pursuant to 35 U.S.C. § 120.

This application is a continuation-in-part of U.S. patent application Ser. No. 09/538,766, filed Mar. 30, 2000, which claims the benefit under 35 U.S.C. § 119(e) of U.S. Provisional Application 60/127,120 filed Mar. 31, 1999.

BACKGROUND OF THE INVENTION

1. Field of the Invention

The invention relates generally to man-made composite building components and their method of manufacture and assembly. More particularly, the invention relates to the production of composite framing members and integrated components such as studs, walls, roofs, floors, and posts.

2. Description of Related Technology

In conventional building construction, building components such as walls, roofs, floors, and posts may be assembled from wooden framing members and sheathing. Framing members. e.g., lumber, may be produced from natural wood cut in standard sizes from trees such as aspen, spruce, pine, and fir. Sheathing, typically made of plywood or oriented strandboard (OSB), is fastened to the frame of a building component using mechanical fasteners and adhesives such as staples, nails, glue, screws or a urethane foam adhesive.

Traditional lumber produced from natural wood generally has shortcomings in consistency, availability, and cost. Likewise, building components made from traditional materials also have shortcomings in consistency, cost, and ease of assembly.

Conventional lumber from natural wood varies widely in quality. Because framing members, such as nominal 2×4s (actually measuring approximately 1½ inches by approximately 3½ inches), are cut whole from trees or logs as solid pieces, they can possess faults inherent in natural wood, such as knots and splits. Knots typically result in reduced strength in a piece of lumber, requiring a high design safety factor leading to inefficient use of materials. In addition, in a condition known as "waning," lumber cut from an outer surface of a tree, particularly from younger, smaller trees, can exhibit an undesirable rounded, rather than squared, edge. Also, subsequent to milling, lumber can take on moisture or dry out, which causes a board to become warped and unusable for its intended purpose. These faults contribute to 30-35% of conventional lumber being of a downgraded quality rating.

The lumber that remains suitable for use in construction must often be trimmed, shimmed, nailed to fit, or otherwise adapted for use due to inconsistencies in dimensional accuracy. Furthermore, once installed, lumber is subject to dimensional instability due to environmental factors or the other factors mentioned above. For example, in a condition known as nail pop, installed lumber dries out and shrinks, causing fasteners to move or break loose. Likewise, accidental contact with water or moisture can cause wood to swell and permanently warp.

Natural wood used to produce lumber also is becoming more and more scarce, especially in larger sizes, due to the depletion of old growth forests. This scarcity naturally leads to reduction in quality and/or to the rising cost of conventional lumber and of the homes and businesses built with lumber.

This application also relates to cellulosic, composite articles. One type of composite article is a wood composite such as a man-made board of bonded wood elements and/or lignocellulosic materials, commonly referred to in the art by the following exemplary terms: fiberboards such as hardboard, medium density fiberboard, and softboard; chipboards such as particleboard, waferboard, strandboard, OSB, and plywood. Wood composites also include man-made boards comprising combinations of these materials.

Many different methods of manufacturing OSB are known in the art, such as, for example, those described in Chapter 4.3 of the Wood Reference Handbook, published by the Canadian Wood Council, and The Complete Manual of Woodworking, by Albert Jackson, David Day and Simon Jennings, the disclosures of which are hereby incorporated herein by reference.

The first step in producing a wood composite is to obtain and sort the logs, which may be aspen, balsam fir, beech, birch, cedar, elm, locust, maple, oak, pine, poplar, spruce, or combinations thereof. The logs may be soaked in hot water ponds to soften the wood for debarking. Once debarked, the logs are then machined into strands by mechanical cutting means. The strands thus produced are stored in wet bins prior to drying. Once dried to a consistent moisture content, the strands are generally screened to reduce the amount of fine particles present. The strands, sometimes referred to as the filler-material, are then mixed in a blending operation, adding a resin binder, wax, and any desired performance-enhancing additives to form the composite raw material, sometimes called the furnish. The resin-coated or resin-sprayed strands then are deposited onto a forming line, which arranges the strands to form a loosely felted mat. The mat thus formed also can be referred to as an array of strands. The mat, including one or more layers of strands arranged with a selected orientation (including, for example, a random orientation), is then conveyed into a press. The press consolidates the mat under heat and pressure, polymerizing the resin and binding the strands together to form a consolidated array of strands with other additives, including the binder. The boards are then conveyed out of press into sawing operations which trim the boards to size.

SUMMARY OF THE INVENTION

It is an object of the invention to overcome one or more of the problems described above.

Accordingly, one aspect of the invention is a composite building component that includes a non-planar molded composite web having two outer zones and two angled zones wherein the caliper of the angled, zones differs from the caliper of at least one of the outer zones, and a flange disposed on an outer surface of an outer zone.

Another aspect of the invention is a composite building component including a web having at least one channel defined by a first outer zone, a second outer zone, and at least two angled zones, each of the zones having a caliper, and each of the zones having inner and outer surfaces; a first flange joined to the web at an outer surface of the first outer zone; a second flange joined to the web at an outer surface of the second outer zone; wherein the width of the building component, measured in a direction parallel to a channel, is not greater than the thickness of the building component, said thickness measured as a distance between parallel outer surfaces of the flanges.

Still another aspect of the invention is a composite building component including a non-planar, molded array of wood strands defining a web panel having a caliper and having first and second undulating principal surfaces, the surfaces providing an alternating pattern of first and second sets of ridges extending parallel to each other and oppositely disposed with respect to a center line of the web panel, adjacent ones of the ridges in the first set being connected to intermediate ones of the ridges in the second set by sloped walls, and the caliper of the web panel between the first and second principal surfaces being different in the vicinity of at least one of the first and second sets of ridges as compared to the sloped walls.

Yet another aspect of the invention is a method of producing a composite building component including the steps of: (a) forming a mat including a wood-based material; (b) providing the mat in a die set, the die set having a non-planar configuration with at least two outer zones and at least two angled zones; (c) closing the die to form a die gap, wherein the die gap in at least one of the outer zones differs from the die gap at the angled zones; (d) consolidating the mat under pressure and heat to form a molded composite web; and (e) joining the web with at least one flange, to form the composite building component.

A further aspect of the invention is a method of producing a building component including the steps of: (a) forming a mat including an array of wood strands; (b) providing the mat in a die set, the die set having a non-planar configuration with first and second die surfaces; (c) closing the die to form a die gap, wherein the die gap provides an alternating pattern of first and second sets of ridges extending parallel to each other and oppositely disposed with respect to a center line of the die set, wherein adjacent ones of said ridges in the first set are connected to intermediate ones of the ridges in the second set by sloped walls formed by the die gap, and wherein the die gap between the first and second die surfaces is different in the vicinity of at least one of the ridges as compared to the sloped walls; (d) consolidating the mat under pressure and heat to form a molded composite web panel; and (e) joining the web with at least one flange, to form the composite building component.

Other objects and advantages of the invention may become apparent to those skilled in the art from a review of the following detailed description, taken in conjunction with the drawings and the appended claims. While the invention is susceptible of embodiments in various forms, described hereinafter are specific embodiments of the invention with the understanding that the disclosure is illustrative, and is not intended to limit the invention to the specific embodiments described herein.

DETAILED DESCRIPTION OF PREFERRED EMBODIMENTS

Figure 1:
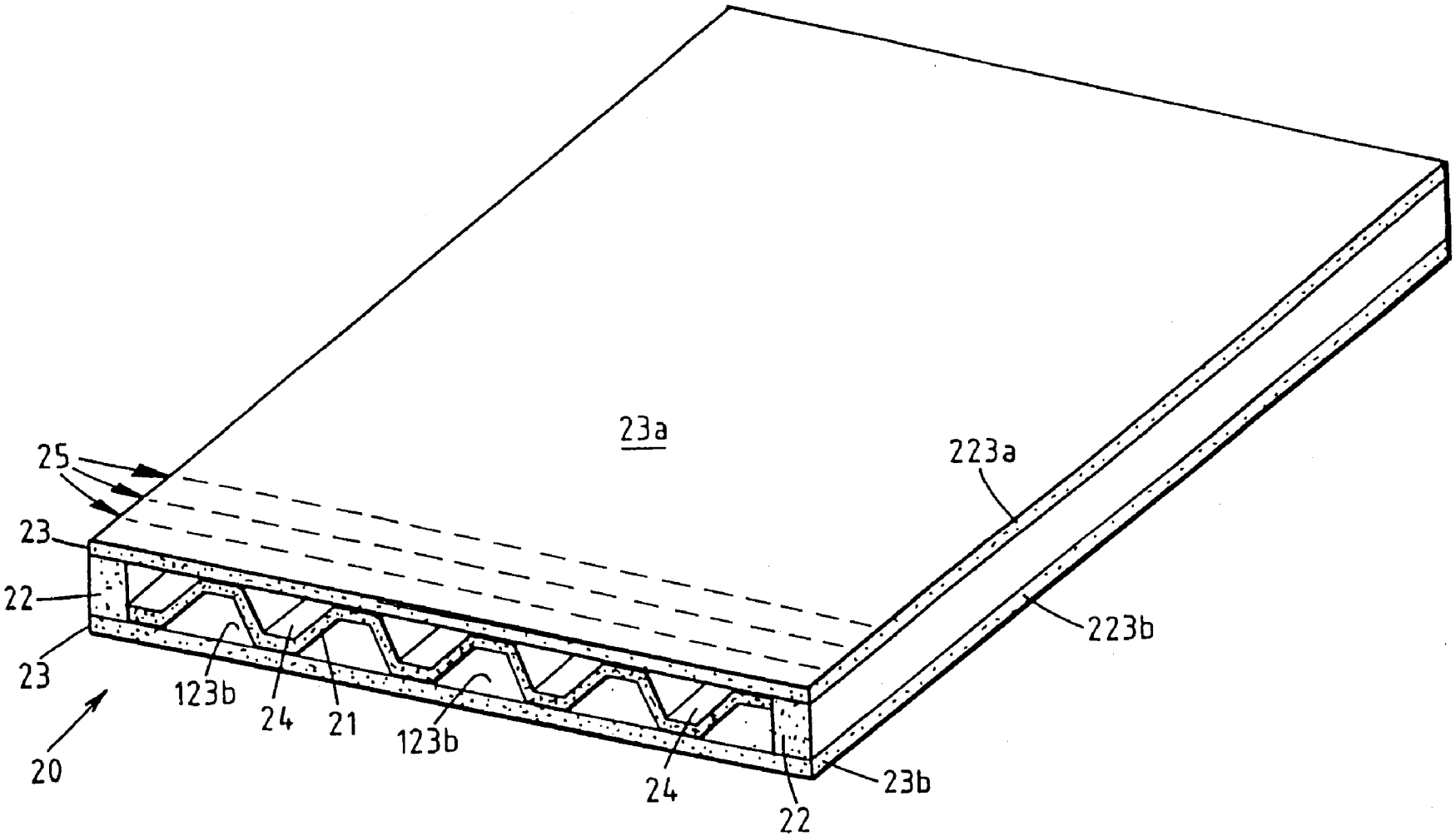
FIG. 1 is an isometric view of a composite building component in accordance with the invention which may serve as a wall or floor system, and which can be divided to provide multiple lumber or post components.

According to the present invention, there is provided a method and apparatus for producing multi-ply or multi-layered composite building components from wood-based materials. The wood-based materials can be, for example, flakes, wafers, particles, fibers, and/or strands, including mixtures thereof. Generally, the building components can be provided by coating or spraying one or more wood-based materials such as flakes or fibers with a resin binder and optionally with a wax and other performance-enhancing fillers to form the composite raw material or furnish. The composite raw material or furnish is formed into a mat of generally uniform basis weight. The mat is loaded into a die set having a desired geometry and consolidated in a heated press to form a composite panel. A die set used to produce a molded or contoured composite panel is described below in detail. One or more of these panels is bonded with a second non-planar or planar flange, and optionally with one or more end blocks or other framing members, to produce a multi-ply wood composite product of the invention. In a preferred embodiment of the invention, the bonded assembly is subsequently cut into multiple multi-ply wood composite building components.

The multi-ply composite building components of the invention preferably include OSB components made from a raw material obtained by breaking down logs or other source of wood into strands, as described above. Various methods of producing these strands are known in the art. The strands preferably are produced through mechanical slicing and flaking. Exemplary sources of wood materials are: aspen, balsam fir, beech, birch, cedar, elm, locust, maple, oak, pine, poplar, spruce, or combinations thereof. Aspen or pine is preferred, but the wood used will depend upon availability, cost, and special use requirements. The type of wood-based material used will define the type of board and properties produced. For example, the invention can include components defined as flakeboard, waferboard, strandboard, OSB, and/or fiberboard. Oriented strandboard is preferred.

Ranges of exemplary and preferred dimensions of strands for use in a preferred composite panel are described below in Table 1.

TABLE I

| | Preferred Strand Dimensions | | |
|---|---|---|---|
| | Length | Width | Thickness |
| Exemplary range | about 2 inches to about 10 inches (about 5 cm to about 25.4 cm) | about ¼ inch to about 3 inches (about 6 mm to about 76 mm) | about 0.007 inch to about 0.05 inch (about 0.18 mm to about 1.27 mm) |
| Preferred range | about 4 inches to about 6 inches (about 10 cm to about 15 cm) | about ½ inch to about 1½ inches (about 12.7 mm to about 38 mm) | about 0.015 inch to about 0.03 inch (about .38 mm to about .76 mm) |

Once produced as described above, the strands preferably are processed to reduce the level of fine particles and dust. This step preferably is achieved by sending the strands through a rotary screen classifier or by other suitable means. In general, the level of fines can be up to about 60 weight percent (wt. %) (based on total weight of the wood-based material) at an about ⅛ inch (about 3.2 mm) screen size or finer, and more preferably in a range of about 20 wt. % to about 30 wt. %. (Unless otherwise noted, the percentages expressed herein are based upon weight.) The mixture of wood-based material is sometimes referred to simply as wood strands.

The moisture content of the processed strands preferably is in a range of about 2 wt. % to about 9 wt. %, and more preferably in a range of about 4 wt. % to about 6 wt. %, based on the weight of the wood-based material.

The strands (and any accompanying particles and dust) then are mixed in a blending operation, preferably adding a resin binder, wax, and any other desired performance-enhancing additives, to form the composite raw material used to produce the boards of the invention. Preferred resin binders include phenolic resins, resorcinol resins, and MDI resins, although any suitable resin can be utilized. Preferably, the resin content is in a range of about 1 wt. % to about 10 wt. % of the weight of the wood-based material, and more preferably in a range of about 3.5 wt. % to about 5.5 wt. %. When using MDI resins, less resin is generally required than when using phenolic or resorcinol resins. In addition to allowing for reduced resin usage, use of an MDI resin allows for decreased press temperatures (resulting in reduced energy input) and permits the use of raw materials with higher moisture contents.

Ingredients can be added to the raw material to impart various beneficial properties to the composite building components of the invention. For example, fire retardants, insecticides, fungicides, water repellants, ultraviolet radiation (UV) blockers, pigments, and combinations thereof can all be used in alternative embodiments of the invention. An exemplary fire retardant is sold under the trademark D-BLAZE by Chemical Specialties, Inc., of Charlotte, N.C. Wax preferably is added to improve moisture resistance, preferably in a range of about ½ wt. % to about 2 wt. % of the weight of the wood strands, for example at about 1 wt. %. An exemplary wax is sold under the trademark EW 58 LV by Borden of Diboll, Tex.

The raw material then is continuously deposited on a forming line to form a mat of generally uniform basis weight. In another embodiment of the invention, the mat can be formed individually in a batch process. The basis weight of a mat is calculated as the volume of the molded panel multiplied by the target density of the molded panel divided by the surface area of the formed mat, and has units $lb/ft^2$ or $kg/m^2$.

The individual strands in the mat can be imparted a selected orientation (generally in the case of OSB), or the mat can be assembled with strands in random orientation. OSB generally refers to a board produced from a mat wherein the strands are imparted with a selected orientation, but can also refer to a board produced from a mat wherein the strands are imparted with or have a random orientation. Individual strand layers within a single mat can, but need not, have different orientations. The strand orientation affects the mechanical performance characteristics of the consolidated composite board, so the preferred strand orientation will differ from application to application.

A continuously-formed mat is then cut to size, having a length and width roughly equal to, or slightly larger than, the length and width of a desired panel produced by a suitable die set. Thus, a consolidated panel is limited in length and width only by the size of the equipment used to produce the panel.

The mat is then loaded into a die set having the desired geometry. The temperature of the press platens and die set during mat consolidation using a phenolic resin preferably is in a range of about 420° F. to about 480° F. (about 215° C. to about 249° C.), and more preferably about 450° F. (about 232° C.). As will be apparent to those of skill in the art, desirable pressing temperatures and pressures can be modified according to various factors, including the following: the die geometry; the type of wood being pressed; the moisture content of the raw material; the press time; and the type of resin that is utilized. The moisture content of the raw material is one important factor which controls the core temperature of the mat that can be achieved under given press conditions and therefore may control the press cycle. Press time can generally be decreased by increasing press temperature, with certain limitations as is known in the art.

Steam injection pressing is a consolidation step that can be used, for example, under certain circumstances in production of consolidated cellulosic composites. In steam injection pressing, steam is injected through perforated one or more heating press platens and/or dies, and then into, through, and then out of a mat. The steam condenses on surfaces of the raw material and heats the mat. The heat transferred by the steam to the mat as well as the heat transferred from the press platens and/or die set to the mat cause the resin to cure. When compared with conventional pressing operations, steam injection pressing can, under certain circumstances, provide a variety of advantages, such as, for example, shorter press time, a more rapid and satisfactory cure of thicker panels, and products having more uniform densities.

According to an embodiment of the inventive method, a first mat is consolidated under heat and pressure in an apparatus configured to produce a molded composite web having one or more contoured features (e.g., features referred to as ridges, ribs, channels, projections, flat zones, upper zones, outer zones, raised zones, or sloped walls), including features upwardly and/or downwardly disposed from a center line or major planar surface of the panel, as described below in greater detail. The compressed panel can be referred to as a molded array of raw material, such as a molded array of wood strands. The projections preferably are evenly spaced apart. Upon pressing, the panel retains integrity and does not fracture. The panel is then edge-trimmed to size.

Preferred embodiments of the inventive articles generally include multiple OSB components which may or may not have the same configuration and composition. Thus, one or more additional mats are each consolidated under heat and pressure in an apparatus configured to produce a panel having a desired configuration. These additional composite panels can be flat or can have molded or contoured features, and are likewise edge-trimmed to size. These additional composite panels are also described in greater detail below.

One or more of the additional panels are aligned and bonded with the first panel, and optionally with end blocks or other framing members, to form a wood composite building component of the invention. Any suitable adhesive can be used to bond the panels and optional end blocks with each other. A preferred bonding adhesive, applied at the interfaces an/or joints between panels, will provide a shear strength that is at least about equal to the shear strength of the composite panels themselves. A preferred bonding adhesive can be selected from the group consisting of hot melt polyurethane, moisture curing hot melt polyurethane, moisture curing polyurethane adhesives, and combinations thereof. The adhesive preferably is applied at a rate in a range of about ¼ oz./ft$^2$ of contacting surface area (about 7.4 ml/cm$^2$) to about ¾oz./ft$^2$ (about 22 ml/cm$^2$), for example about ½ oz./ft$^2$ (about 14 ml/cm$^2$). In an alternative embodiment of the invention, waterproof resorcinol adhesives or an isocyanate or MDI-based adhesive can be used. In another alternative embodiment, the glue can either be replaced with or assisted by mechanical fasteners, such as staples.

In a preferred embodiment of the invention, the bonded assembly is subsequently cut into multiple wood composite building components, as described below.

The advantageous properties of the inventive product allow it to be an excellent component in construction applications such as lumber components, floors, walls, roofs, and framing members. This process according to the invention produces a composite component that integrates an engineered combination of various desired properties useful in building components such as compressive and bending strength, bending stiffness, impact deflection, and increased resistance to water, insects, bacteria, and fire.

Various preferred embodiments of the invention will now be described in more detail.

Composite Lumber

The inventive process can be used to produce a composite lumber product of the invention suitable as a replacement for conventional lumber, or an embodiment engineered with dimensions and strength characteristics for specific applications not suitable for conventional lumber. Referring initially to FIG. 1 for an overview of a product produced in accordance with the invention, these inventive multi-ply composites involve a bonded assembly 20 as an intermediate component. The component 20 includes one or more web panels 21 (one shown), and one or more end blocks 22 (two shown) sandwiched between two flanges 23 (two shown). The flange 23 in FIG. 1 is a flat panel, but this need not be the case. The bonded assembly 20 preferably is cut in a direction perpendicular to channels 24 in the web panel 21 along lines 25 to produce individual multi-ply wood composite lumber components of the invention (see FIGS. 9 and 10), each composite lumber component having one or more webs 21, flanges 23, and optional end blocks 22.

It is to be understood that the terms web, flange, and end block are used to refer to these individual components either as panels and beams in the bonded assembly 20 or as elements of the individual lumber components produced by dividing the bonded assembly 20 along lines 25, as described above and shown in FIG. 1. Thus, for example, although the terms web and web panel are interchangeable, the term web panel can be used to emphasize a relatively larger sized element, e.g., element 21 in FIG. 1, prior to being divided as described herein.

A method of producing one embodiment of a web panel 21 will now be described with respect to a composite lumber embodiment of the invention. It is to be understood, however, that the characteristics of the web panel 21 and its method of manufacture are equally applicable to a web panel 21 used alone in certain applications and in applications with additional components, including the other embodiments of the invention described later, such as, for example, a decking component.

In a preferred method of producing a composite lumber product of the invention, the mat which will become the web panel 21 is formed of up to three layers of resin-coated, loosely felted, oriented strands in the continuous process described above. The mat can be referred to as comprising an array of wood strands. For example, a first, or bottom, layer is formed in the direction parallel to the longitudinal axis of a finished lumber component. This first layer preferably constitutes about ⅓ to about 100% of the total mat weight. A second, or middle, layer can be formed perpendicular to the direction of the first layer and can comprise up to about ⅓ of the total mat weight. A third, or top, layer can be formed parallel to the first layer and can constitute up to about ½ of the total mat weight. In other words, from one to three layers preferably are included in the mat, wherein each layer generally has strands oriented in a direction perpendicular to the strands in an adjacent layer. In one preferred embodiment, each layer comprises about ⅓ of the total weight of the mat.

In another preferred embodiment, about 80% to about 100% of the strands are oriented in the direction parallel to the longitudinal axis of a lumber component, for example about 90% of the strands. In one version of that embodiment having three layers, the strands oriented in the direction parallel to the longitudinal axis of a lumber component are distributed approximately equally, e.g., by weight, between the top and bottom layers of the mat. In another version of such an embodiment having multiple layers, the strands oriented in the direction parallel to the longitudinal axis of a lumber component are distributed approximately equally by weight throughout all layers of the mat.

In one preferred embodiment, the dimension of the web panel 21 in the direction perpendicular to the channels 24 roughly corresponds to the desired length of a completed composite lumber product of the invention. In another preferred embodiment, the dimension of the web panel 21 in the direction perpendicular to the channels is less than the desired length of the completed composite lumber component of the invention to provide space for end block beams 22, as in the embodiment of FIG. 1. In such a case, the web panel 21 preferably is bonded to the flange 23 in such a manner as to leave an approximately equivalent gap at opposing ends of the bonded assembly 20 along lines 25. These embodiments are discussed in more detail below in conjunction with the end blocks 22.

The width of the web panel 21 (i.e., in the direction perpendicular to the lines 25) and, thus, the mat used to produce web panel 21, preferably is as great as possible in order to maximize the efficiencies of production of multiple lumber components from one bonded assembly 20. For example, in a 4 foot (about 1.2 m) by 8 foot (about 2.4 m) heated press used to produce composite lumber about 8 feet (about 2.4 m) long, the web panel 21 preferably is about 4 feet (about 1.2 m) wide. Most preferably, an 8 foot (about 2.4 m) by 24 foot (about 7.3 m) heated press is used to produce composite lumber about 8 feet (about 2.4 m) long, with a web panel 21 preferably about 24 feet (about 7.3 m) wide (i.e., in the direction perpendicular to the lines 25).

Figure 2:
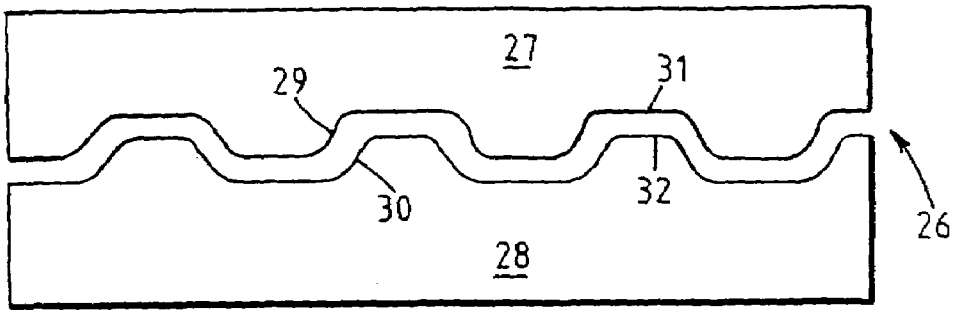
FIG. 2 is a cross-sectional view of a die set used to mold a web panel embodiment of the invention.

A preferred process for producing an inventive composite lumber article will now be described. Referring to FIG. 2, a loosely felted web mat (not shown), produced as described above, is loaded into a die set 26 having a preferred unique configuration for producing a web panel 21 having parallel channels 24 with sloped walls. The die set 26, including a first (upper) die 27 and a second (lower) die 28, determines the profile geometry of the consolidated web panel 21.

As the die set 26 is closed on the mat, the wood strands of the mat preferably shift or slide within the matrix of the mat (or, in one embodiment of the invention, within the array of wood strands), grossly conforming to the die configuration. It has been found that, due to compressing and shearing forces on the mat created by the interaction between the upper die 27 and the lower die 28, the surface area of the mat can increase as much as 75 percent, preferably about 15 to about 25 percent, most preferably about 20 percent. Because of the unlocked state of the strands in the loosely felted mat, they generally tend to shift at certain regions of the mat during the compression operation. Factors influencing the amount that the surface area of a mat may increase during pressing using the process of the invention include: the geometry or contours of the web panel 21 (or, in other words, the contours or profile of the web panel 21); the variation in caliper among various locations of the web panel 21 (or, in other words, the variation in die gap among various locations of die set 26); the mat basis weight and orientation of the strands prior to press closure; and the strand geometry (including physical length, width and thickness). These factors affect the ability of the strands to shift or slide within the matrix of the mat before bypassing, fracturing, or destroying the continuity of the composite mat during press closure. The process used and the unique die configuration used according to the invention help to optimally combine these factors so that the surface area of the mat can increase without fracturing the mat, especially at the outer zones 33. At the same time, the process preferably provides a product with at least substantially uniform density, resulting in increased strength of the molded board and of objects constructed therefrom. In contrast, compressed products of prior methods have been characterized by undesirable density variations, resulting in reduced strength of a molded board and of objects constructed therefrom.

The temperature of the press platens and/or die set during mat consolidation using a phenolic resin preferably is in a range of about 420° F. to about 480° F. (about 215° C. to about 249° C.), and more preferably about 450° F. (about 232° C.). The pressing time depends on the caliper of the finished product and the other factors listed above, but is generally in a range of about 1 minute to about 5 minutes in preferred embodiments of the invention.

The caliper of a consolidated web at any particular point is defined by a distance or gap between the first die 27 and second die 28 during pressing and consolidation of a mat. For example, the die gap at one location of the die set 26 is defined by the distance between point 29 and point 30 in FIG. 2. Another measurement of die gap can be made, for example, at points 31 and 32. As the result of specified variations in the die gap, the die set 26 of the invention preferably produces a web panel 21 having a caliper that varies from one point to another (e.g., differing at the locations of the web corresponding to locations 29/30 and 31/32 of the die set 26 of FIG. 2) to achieve an at least substantially uniform density throughout the web panel 21. This aspect of the invention not only maximizes the stiffness properties of the web 25, but also maintains the integrity of the mat during compression.

Figure 3:
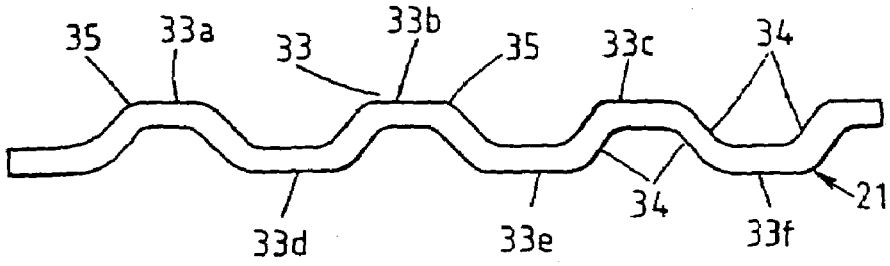
FIG. 3 is a cross-sectional view of a web panel embodiment of the invention.
Figure 4:
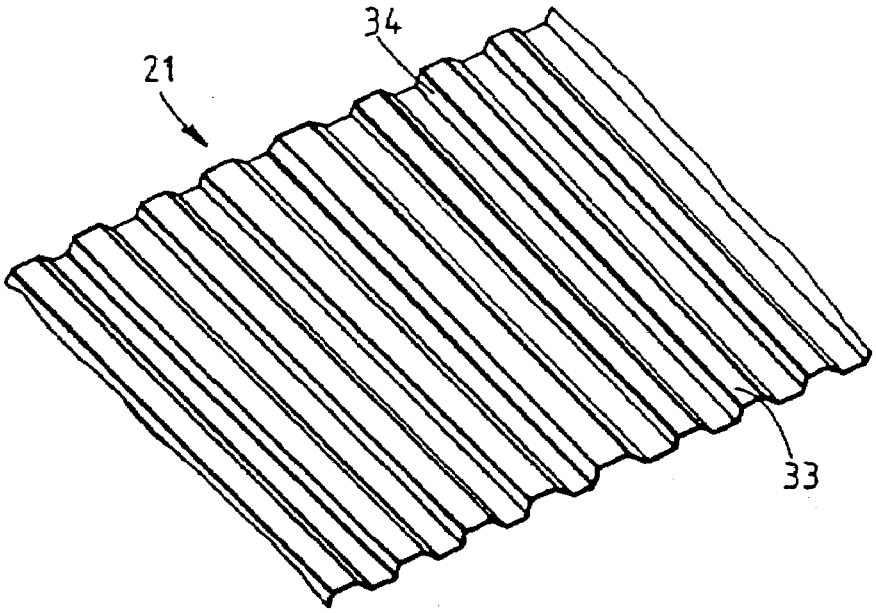
FIG. 4 is an isometric view of a web panel embodiment of the invention.

FIG. 3 illustrates the cross-sectional geometry of a web panel 21 of the invention produced by the die set 26 of FIG. 2. FIG. 4 provides an isometric view of the web panel 21 produced by the die set 26. (Like reference numbers in the figures refer to like elements.) The web panel 21 shown in FIGS. 3 and 4 has (a) multiple generally planar longitudinally extending outer zones 33 and (b) multiple longitudinally extending inner or angled zones 34 that are disposed between, contiguous with, and integrally formed with the outer zones 33. The outer zones 33 are disposed upwardly of (e.g., elements 33*a*, 33*b*, and 33*c* in FIG. 3) and downwardly of (e.g., elements 33*d*, 33*e*, and 33*f* in FIG. 3), contiguous with, and integrally formed with the angled zones 34. Preferably, the intersection of the outer zones 33 with the angled zones 34 is radiused. An upper surface of the web panel is formed by contact with the first die 27, and a lower surface of the web panel is formed by contact with the second die 28. When the web 21 includes a set of upwardly disposed outer zones (e.g., zones 33*a*, 33*b*, and 33*c*) and a set of downwardly disposed outer zones (e.g., zones 33*d*, 33*e*, and 33*f*), preferably the adjacent outer zones (e.g., zones 33*a* and 33*d*) are spaced apart laterally a predetermined distance and vertically a predetermined distance.

Preferably, the caliper of the web 21 at the upwardly disposed outer zones 33*a*, 33*b*, and 33*c* (as shown in FIG. 3) is less than (thinner than) the caliper of the web 21 at the angled zones 34. The caliper of the web 21 at the downwardly disposed outer zones 33*d*, 33*e*, and 33*f* preferably is greater than the caliper of the web 21 at the upwardly disposed outer zones 33*a*, 33*b*, and 33*c*, and is at least about equal to the caliper of the web 21 at the angled zones 34. Preferably, the caliper of the web 21 at an intersection between an outer zone 33 and an angled zone 34 transitions gradually between the caliper of the web 21 at each of the respective zones 33 and 34, most preferably via a radiused intersection. These calipers are provided by setting the die gap, as described above. More specifically, the ratio of the caliper of the upwardly disposed outer zones 33*a*, 33*b*, 33*c* to the caliper of the angled zones 34 and downwardly disposed outer zones 33*d*, 33*e*, 33*f* preferably is in a range of about 0.75 to about 1.0, and more preferably is in a range of about 0.8 to about 0.9, for example about 0.85. The differing calipers provide substantial and unexpected advantages in production and use of the web 21 in the building components of the invention.

In one preferred embodiment, the caliper of the web tapers (for example, by linear decrease in caliper) from a thicker downwardly disposed outer zone (e.g., zone 33*d* in FIG. 3), through an angled zone (e.g., zone 34), to a thinner upwardly disposed outer zone (e.g., zone 33*b*), wherein the taper extends through the junctions between the various zones. The die gap at the various zones is adjusted to account for the redistribution of raw material in the mat caused by gravity and the closing of the die set 26 so that the web 21 after formation has a substantially uniform density. Thus, the caliper of the web 21 preferably is relatively larger where more raw material is distributed in the die gap, for example in the vicinity of locations 29/30 in FIG. 2, than where less material is distributed in the die gap, for example in the vicinity of locations 31/32.

In a composite lumber embodiment of the invention, the caliper of the web 21 preferably is in a range of about ⅛ inch to about 1 inch (about 3.18 mm to about 25.4 mm), more preferably in a range of about ¼ inch to about ½ inch (about 6.35 mm to about 12.7 mm). The caliper at the outer zones 33*a*, 33*b*, 33*c* preferably is in a range of about 0.215 inch to about 0.465 inch (about 5.5 mm to about 11.8 mm), while the caliper at the outer zones 33*d*, 33*e*, 33*f* preferably is in a range of about 0.250 inch to about 0.50 inch (about 6.35 mm to about 12.7 mm).

The web panel 21 according to the invention preferably has a specific gravity in a range of about 0.6 to about 0.9 at any location in the panel, more preferably about 0.65 to about 0.75, most preferably about 0.75 when using southern yellow pine as the cellulosic component in the raw material. The overall specific gravity of the panel preferably is in a range of about 0.6 to about 0.9, more preferably about 0.65 to about 0.75, most preferably about 0.75 when using southern yellow pine as the cellulosic component in the raw material, making it a high density wood composite. The varying die gap preferably allows for the production of a web panel 21 having an at least substantially uniform density throughout its profile. Preferably, the density of the web 21 at an outer zone 33 is at least about 75% of the density of the web 21 at an angled zone 34, more preferably at least about 90%, for example about 95%. Likewise, the density of the web 21 at an upwardly disposed outer zone (e.g., 33*a*) preferably is at least about 75% of the density of the web 21 at a downwardly disposed outer zone (e.g., 33*d*), more preferably at least about 80%, most preferably at least about 90%, for example about 95%.

Figure 5:
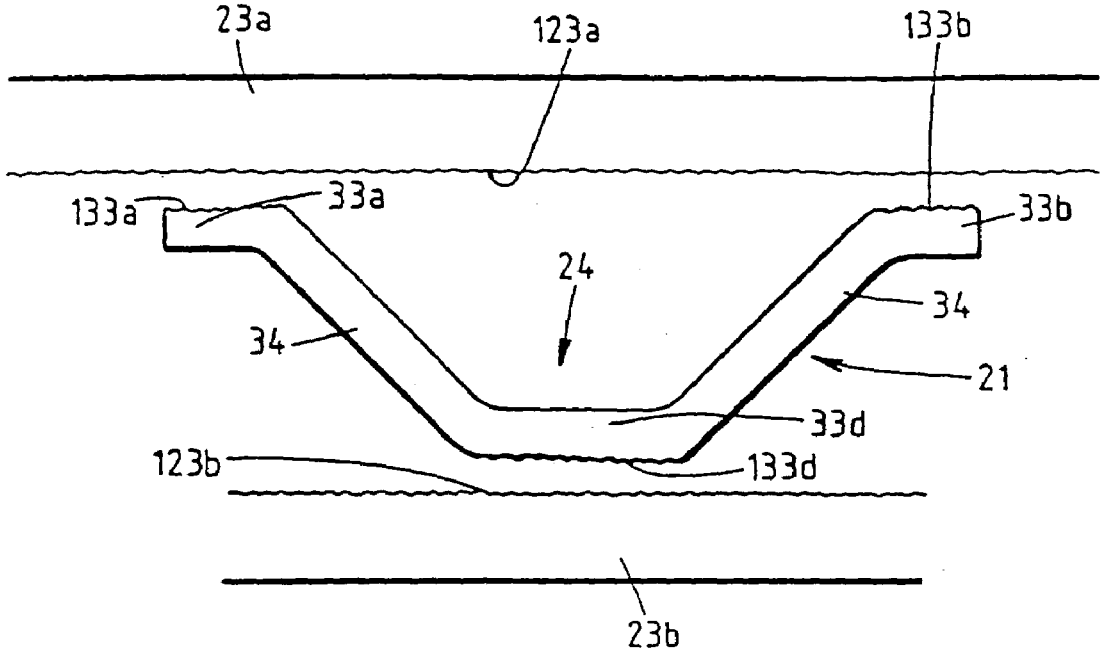
FIG. 5 is a side elevation with portions removed of a web panel and flange panels used in an embodiment of the invention and having textured surfaces.

Whereas the outer zones 33 of the web panel 21 shown in FIGS. 3 and 4 are generally flat (planar), in an alternative embodiment the outer zones 33 may be curvilinear or may have a combination of curved and flat surfaces or may have surfaces of other shapes and/or textures. For example, a texture, contour, or other surface can be provided on outer surfaces of the outer zones 33 of the web 21 to provide improved interlock or bonding with other components of the final lumber product, such as a flange 23, end block 22, or additional web 21. For example, FIG. 5 illustrates a portion of a web 21 and flanges 23*a* and 23*b* having textured surfaces 123*a* 123*b*. Further, a lower surface 133*d* of the outer zone 33*d* has an alternating ribbed and grooved texture that provides mechanical interlock and/or grip, with ribs and grooves of the surface 123*b* of the flange 23*b*. In one preferred embodiment, the lower surface 133*d* of the outer zone 33*d* has the same texture as the upper surface 123*b* of the flange 23*b*, but in other embodiments the textures can be slightly or completely different. The texture can include any feature that, when present on one or more surfaces of a web 21, end block 22, or flange 23, provides improved bonding (e.g., grip, frictional resistance, adhesion, or interlock) to a surface of any other component of a composite building component, with or without the use of an adhesive. The surfaces 123*a*, 133*a*, 133*b* likewise can be textured to provide improved bonding as noted above.

Thus, it is understood that the use of the term flat herein refers to a generally planar portion. In another alternative embodiment, an outer zone 33 can be the peak of a curved portion of the web 21. In yet another embodiment, an outer zone 33 can have a caliper that increases or decreases from the center of the zone 33 to the end of the zone 33 which is contiguous with, and integrally formed with, an angled zone 34.

Figure 6:
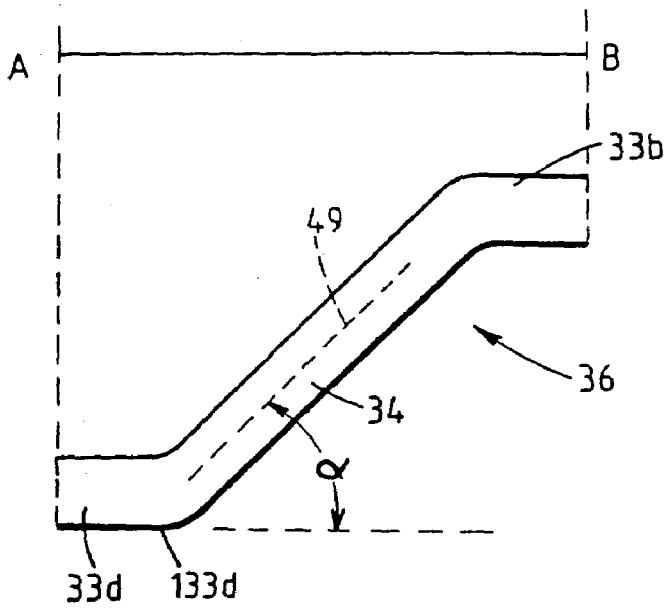
FIG. 6 is a side elevation of a segment of web panel used in an embodiment of the invention.

Likewise, the angled zones 34 shown in FIG. 3 are generally flat (planar) (as also shown in FIGS. 5 and 6), but can also have contours. For example, a web 21 can have a cross section in the shape of a sinusoidal curve. In another embodiment, the angled zones 34 shown in FIG. 3 can incorporate one or more flat (planar) zones, for example flat zones which are substantially perpendicular to the outer zones 33 of the web 21.

Figure 15:
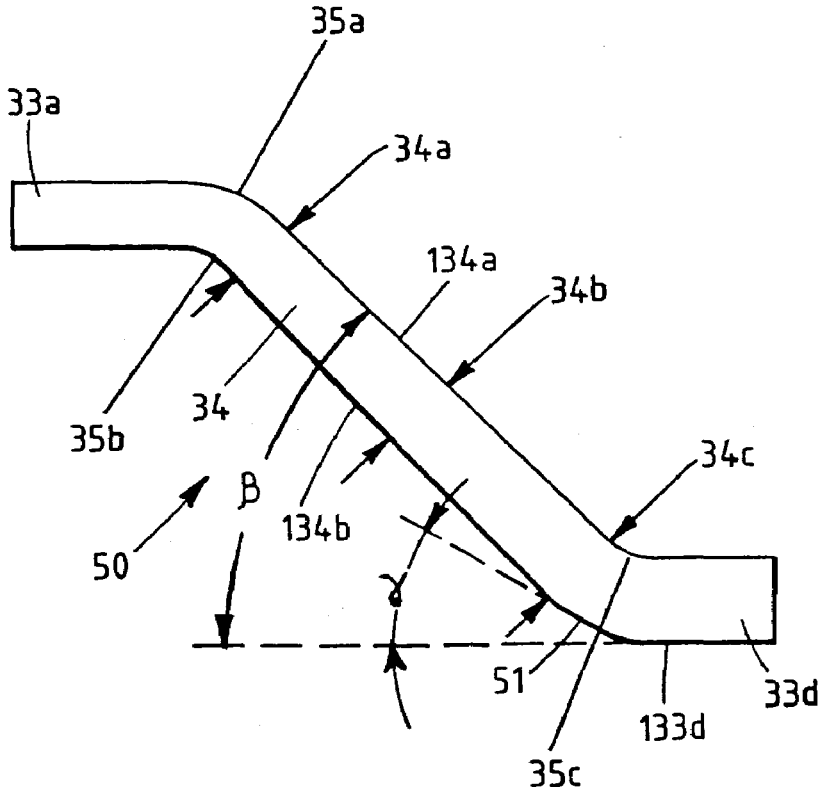
FIG. 15 is a side elevation of a tapered segment of web panel used in an embodiment of the invention.

The angled zones 34 can form various angles with the outer zones 33. These angles can be referred to as draft angles. For example, referring to FIG. 6, the angle $\alpha$ between a lower surface 133*d* of an outer zone (e.g., 33*d*) and the centerline 49 of an angled zone 34 is a draft angle of the web segment 36. Referring to FIG. 15, an embodiment of the web 21 characterized by a tapering caliper in an angled zone 34, the preferred design has a draft angle $\beta$ between a surface 133*d* of an outer zone (e.g., 33*d*) and an upper surface 134*a* of an angled zone 34. In this case, the angle between the lower surface 133*d* of an outer zone (e.g., 33*d*) and a lower surface 134*b* of the angled zone 34 is determined by the selected degree of taper in this portion of the web 21.

Draft angles $\alpha$ and $\beta$ of a web 21 preferably are in a range of about 30 degrees to about 60 degrees, more preferably in a range of about 35 degrees to about 55 degrees, and most preferably in a range of about 40 degrees to about 50 degrees, for example about 45 degrees in a preferred composite lumber article. In another embodiment of the invention, the draft angle $\alpha$ or $\beta$ of a web 21 is greater than 45 degrees. The increased draft angles, especially draft angles greater than about 45 degrees, provide substantial advantages in the web panel 21 of the invention, such as the ability to span greater distances with reduced material cost and increased strength.

Figure 7:
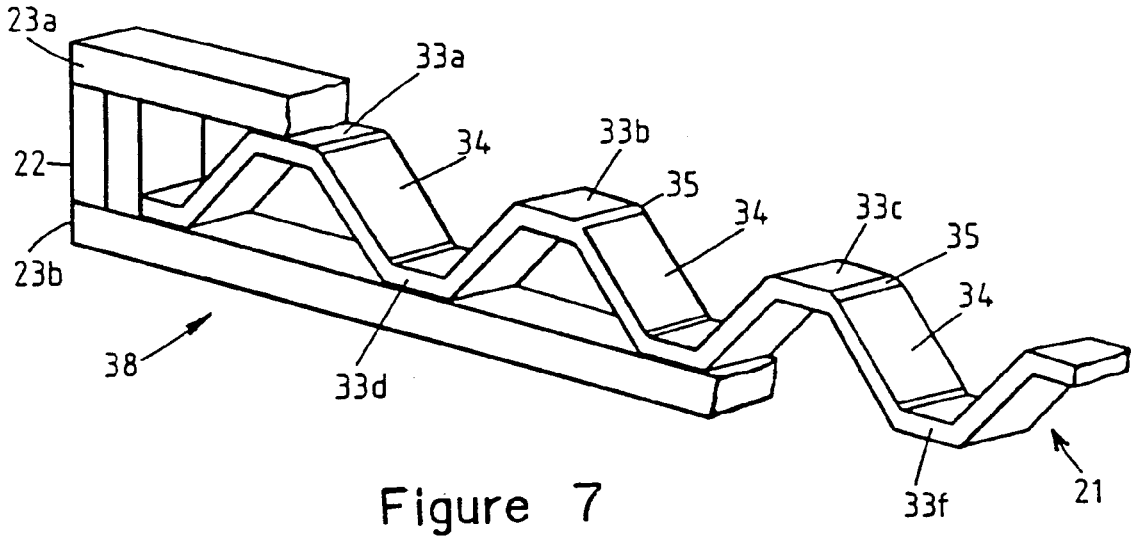
FIG. 7 is a cut-away isometric view of a portion of a composite nominal 2×4 lumber component embodiment of the invention.

Referring to FIG. 7, there is shown a composite lumber embodiment of the invention 38 having upper and lower flanges 23*a* and 23*b*, respectively, a web 21 sandwiched between the flanges 23*a* and 23*b*, and an optional end block 22. A surface having an outer radius 35 is defined at an intersection of an outer zone 33 and an angled zone 34 (i.e., a radiused intersection). This is shown in greater detail in FIG. 15 wherein a radius 35*a* is formed at an intersection of an upwardly disposed outer zone 33*a* and an angled zone 34 by the upper surface of the web 21. Such a radius, at an outer surface of the web 21 (i.e., in the vicinity of an upper surface of an upwardly disposed outer zone, e.g., 33*a*, or a lower surface of a downwardly disposed outer zone, e.g., 33*d*), can be referred to as an outer radius or shoulder. FIG. 15 shows a radius 35*b* formed at an intersection of an upwardly disposed outer zone 33*a* and an angled zone 34 by the lower surface of the web 21. Similarly, FIG. 15 shows a radius 35*c* formed at an intersection of an downwardly disposed outer zone 33*d* and an angled zone 34 by the upper surface of the web 21. A radius such as radius 35*b* or 35*c* at an inner surface of the web 21 (i.e., in the vicinity of a lower surface of an upwardly disposed outer zone, e.g., 33*a*, or an upper surface of a downwardly disposed outer zone, e.g., 33*d*) can be referred to as an inner radius. Preferably, the inner radii (e.g., radius 35*b* and 35*c*) are smaller than the outer radii (e.g., radius 35*a*). When a web 21 is tapered as in FIG. 15, preferably a radius 35*b* is smaller than a radius 35*c*.

A radius 35 of the web 21 generally varies with the overall caliper of the web 21. For example, the radius 35*a* of the web 21 at the intersection between an angled zone 34 and an upwardly disposed outer zone (e.g., 33*a*) generally varies with the caliper of the upwardly disposed outer zone (e.g., 33*a*). Preferably, the radius 35*a* dimension is equal to about one to about three times the caliper at adjacent zones of the web 21. In a specific embodiment, this dimension is approximately 1.5 times the caliper of the web 21 at the adjacent outer zone.

Exemplary radii 35*a* are tabulated in Table II below for various calipers of an upwardly disposed outer zone 33.

TABLE II

Exemplary Web Radii 35a (Approximate Values)

| Caliper of Upwardly Disposed Outer Zone 33 | Radius 35a |
|---|---|
| 0.125 in. (3.175 mm) | 0.1875 in (4.76 mm) |
| 0.25 in. (6.35 mm) | 0.3125 in (7.93 mm) |
| 0.375 in. (9.525 mm) | 0.4375 in (11.1 mm) |
| 0.5 in. (12.7 mm) | 0.5625 in (14.3 mm) |
| 0.625 in. (15.875 mm) | 0.6875 in (17.5 mm) |
| 0.75 in. (19.05 mm) | 0.8125 in (20.6 mm) |

The profile thickness or profile depth of the web 21 (measured by the greatest depth of the web, for example, referring to FIG. 5, the distance from a top surface 133*a* of zone 33*a* to a bottom surface 133*d* of zone 33*d*) preferably is in a range of about ¼ inch to about 8 inches (about 6.35 mm to about 20.32 cm), and more preferably in a range of about ¼ inch to about 4 inches (about 6.35 mm to about 10.16 cm).

The depth of draw of a web 21 is measured as the vertical distance traveled by an angled zone 34 between the center lines of adjacent outer zones (e.g., the zones 33*a* and 33*d*). Whereas the depth of draw can be uniform throughout a web 21, this need not be the case. Thus, for example, the top surfaces of the outer zones 33*a*, 33*b*, and 33*c* are preferably, but optionally, in a single plane. The depth of draw of the web 21 preferably is about 6 inches (about 15.24 cm) or less, and more preferably in a range of about ¼ inch to about 3½ inches (about 6.35 mm and about 88.9 mm). In one preferred embodiment of the invention, the depth of draw of the web 21 is greater than the caliper of any zone.

A web segment 36, depicted in FIG. 6, is defined as a portion of a web 21 between a longitudinal midpoint of a downwardly disposed outer zone 33 and the longitudinal midpoint of an adjacent upwardly disposed outer zone 33 (e.g. midpoint of 33*d* to midpoint of 33*b*). This distance, web segment 36 length (measured along the line segment A-B shown in FIG. 6), depends on the draft angle of the angled zone 34, the depth of draw in the web segment, and the lengths of the downwardly disposed outer zone 33*d* and the upwardly disposed outer zone 33*b*. In a web 21 in which all web segments 36 are identical, the frequency of web segment repeat is defined as the inverse of the length of the web segment 36.

The strength properties of composite lumber articles depends in part on the frequency of web segment repeat. In general, as the frequency of web segment repeat increases, the deflection strength of the lumber article increases. The following design factors interrelate to provide deflection resistance of a web, and therefore to an article including the web: (a) length of the lumber desired; (b) width of end block used (if any); (c) draft angle of angled zone 34 (which itself depends on the raw material used and the depth of draw); (d) web caliper at the various zones and intersections of the zones; (e) web 21 density; (f) area of interface between web 21 and flange 23; and (g) type and amount of adhesive between web 21, one or more flanges 23, and one or more end blocks 22. These factors can be selected so as to achieve a desired deflection resistance.

FIG. 15 shows another preferred feature of a web 21, wherein a portion 51 of the lower surface of the web 21 in the vicinity of the intersection between an angled zone 34 and a downwardly disposed outer zone (e.g., 33*d*) is substantially flat (planar) and forms an angle γ with respect to the lower surface 133*d* of a downwardly disposed outer zone (e.g., 33*d*). This feature can be referred to as a flattened shoulder 51. This feature permits the caliper of the web 21 to be manipulated or determined at the intersection of an angled zone 34 and a downwardly disposed outer zone (e.g., 33*d*). When incorporating this feature, the intersections of the flattened shoulder 51 with the surface of an angled zone 34 at one end (e.g., the lower surface), and the surface of an outer zone (e.g., the lower surface of downwardly disposed outer zone 33*d*) at the other end preferably is radiused.

Preferably the angle γ and length of the flattened shoulder 51 are selected to provide a caliper of the web 21 in the vicinity of the intersection between an angled zone 34 and an outer zone (e.g., downwardly disposed outer zone 33*d*) that transitions between the caliper of an outer zone and the caliper of an angled zone 34. Most preferably, the angle γ and length of the portion 51 are selected to provide a web caliper 21 in the vicinity of the intersection between an angled zone 34 and an outer zone (e.g., downwardly disposed outer zone 33*d*) that corresponds to the distribution of raw material in the die set 26 in the vicinity of the intersection between the angled zone 34 and the outer zone (e.g., 33*d*) after the die set 26 is closed, to provide a substantially uniform density of the web 21. Thus, preferably the flattened shoulder 51 feature is used at the intersection of an angled zone 34 and a downwardly disposed outer zone, e.g., 33*d*.

The angle γ preferably ranges between about 20 and about 50 degrees, and more preferably is between about 25 and about 35 degrees. In an exemplary embodiment, the angle γ is substantially equal to 31 degrees.

In another embodiment of the invention, the consolidated web panel 21 has first and second undulating principal surfaces, formed by the first (upper) die 27 and the second (lower) die 28, respectively. The first and second principal surfaces provide an alternating pattern of first and second sets of ridges extending parallel to each other and oppositely disposed with respect to a center line of the web panel 21 (e.g., elements 33 in FIG. 3). Adjacent ones of the ridges in the first set (e.g., elements 33*a*, 33*b*, and 33*c* in FIG. 3) are connected to intermediate ones of the ridges in the second set (e.g., elements 33*d* and 33*e* in FIG. 3) by sloped walls (e.g., elements 34 in FIG. 3). Preferably, at least one principal surface is radiused in the vicinity of the connection between a ridge and a sloped wall. The caliper of the web panel 21 between the first and second principal surfaces is different in the vicinity of at least one of the first and second sets of ridges (e.g., elements 33*a*, 33*b*, and 33*c*, and elements 33*d*, 33*e*, and 33*f* in FIG. 3, respectively) as compared to the sloped walls (e.g., elements 34 in FIG. 3).

Characteristics of this web panel 21 embodiment of the invention can be the same as those of the previously-described web panel 21. For example, in a preferred embodiment, the caliper of the web 21 gradually increases or decreases from a sloped wall to a ridge via a radiused connection.

Referring to FIG. 1, to create a composite lumber component one or more consolidated web panels 21 are bonded with two flange panels 23 and optionally with two end block beams 22 to form the bonded assembly 20 of FIG. 1. In general, the flange panels 23 of a composite lumber product of the invention can be made from any material. Exemplary flange materials are: laminated veneer lumber (LVL), solid conventional lumber, plywood, laminated strand lumber (LSL), parallel strand lumber (PSL), particle board, OSB, strand board (wafer board), fiberboard, corrugated board, kraft paper, plastics, fiberglass, and metals. The flange material optionally can include performance-enhancing materials such as those described above in relation to the web 21.

The flange 23 also contributes to the deflection resistance of a composite lumber product. Thus, the flange preferably is made from a material that, in combination with the web, provides the desired deflection resistance for a particular application. In one preferred embodiment of the invention, the flanges are OSB, made from the same raw material as the web 21 according to the methods described above. In such an embodiment, the strands of the flange 23 preferably are oriented in the direction perpendicular to the channels 24 of the web 21, and the caliper of the flange 23 preferably is in a range of about ⅛ inch to about 1 inch (about 3.2 mm to about 25.4 mm). The opposing flanges preferably are of about equal caliper, however, the inventive articles can use two completely different flanges (both with respect to caliper and material) in certain applications.

The flange 23 of the lumber article preferably is generally planar with a uniform cross-sectional dimension (or caliper). However, it is to be understood that other flange configurations are useful with the invention. For example, in one alternative embodiment, a flange 23 itself is a web 21 having one or more of the characteristics described above. When a flange 23 is itself a web 21, the term nominal flange 23 is used to refer to its particular web-like properties. Alternatively, such a multi-ply assembly may be referred to simply as including one or more web 21 panels. Preferably, such a nominal flange 23 has a relatively small depth of draw [e.g., in a range of about 1/16 to about ½ inch (about 1.6 mm to about 12.7 mm)], a frequency of web segment 36 repeat, and outer zone 33 length sufficient such that one or more outer zones 33 of the nominal flange 23 comes into contact with one or more outer zones 33 of the web 21.

Preferably, the flange 23 panels have one dimension, referred to hereafter as length, which is approximately equal to the length of the desired composite lumber article. Referring to FIG. 1, depicting a bonded assembly 20, the length of flange 23 panels is measured along lines 25. The dimension of the flange 23 panels in the planar perpendicular direction (width) can be any practical size, and preferably is about equal to the width of the web 21 panel in the bonded assembly 20.

In general, an optional end block 22 of the composite lumber article of the invention can be made from any material or combinations of materials, including laminated veneer lumber (LVL), solid conventional lumber, plywood, laminated strand lumber (LSL), parallel strand lumber (PSL), particle board, OSB, strand board (wafer board), fiberboard, corrugated board, kraft paper, plastics, fiberglass, and metals. Preferably, the end block 22 is constructed of material of sufficient strength to hold a mechanical fastener, most preferably of a nailable material. In one preferred embodiment of the invention, an end block 22 is constructed from particleboard. In another preferred embodiment of the invention, an end block 22 is constructed from the offstock of flange 23 production. Preferably, opposing end blocks 22 are made from the same materials, however, the invention can include end blocks 22 made from two different materials or two end blocks 22, each made from different materials.

An optional end block 22 beam preferably has a length roughly equivalent to the width of the flange panels 23 (which is roughly equivalent to the width of the web panel 21).

Referring to FIG. 1, an optional end block 22 preferably has a width sufficient to span a predetermined gap between outer edges 223*a* and 223*b* of flange panels 23*a* and 23*b* and the end of a web panel 21 (not visible) on each end of the bonded assembly 20. Preferably, the end block 22 is sufficiently large to provide an adequate volume of solid material to hold a mechanical fastener when the lumber is installed.

Referring to FIGS. 1 and 5, an optional end block 22 beam preferably is sufficiently large to span a gap formed between inner faces 123*a* and 123*b* of opposing flanges 23*a* and 23*b* in the bonded assembly 20. In a composite lumber article of FIG. 1 wherein the length of a web panel 21 in the direction perpendicular to the channels 24 along lines 25 is less than the length of flanges 23 along lines 25, the end block 22 beam thickness preferably is about equal to the depth of draw of the web panel 21. In another embodiment, the length of a web panel 21 in the direction along the lines 25 is roughly equal to the length of the flange 23 panels (wherein an outer zone 33 of the web 21 extends to the outer edges 223*a* and 223*b* of the flanges 23). In such an embodiment, a preferred end block 22 has a thickness about equal to the depth of draw of the web 21, less the caliper of a terminal outer zone 33. In other words, in such an embodiment the end block 22 has a thickness no larger than the gap formed between the inner surface of the outer zone 33 of the web 21 and the inner surface (e.g., 123*a*) of the opposing flange 23.

Figure 10:
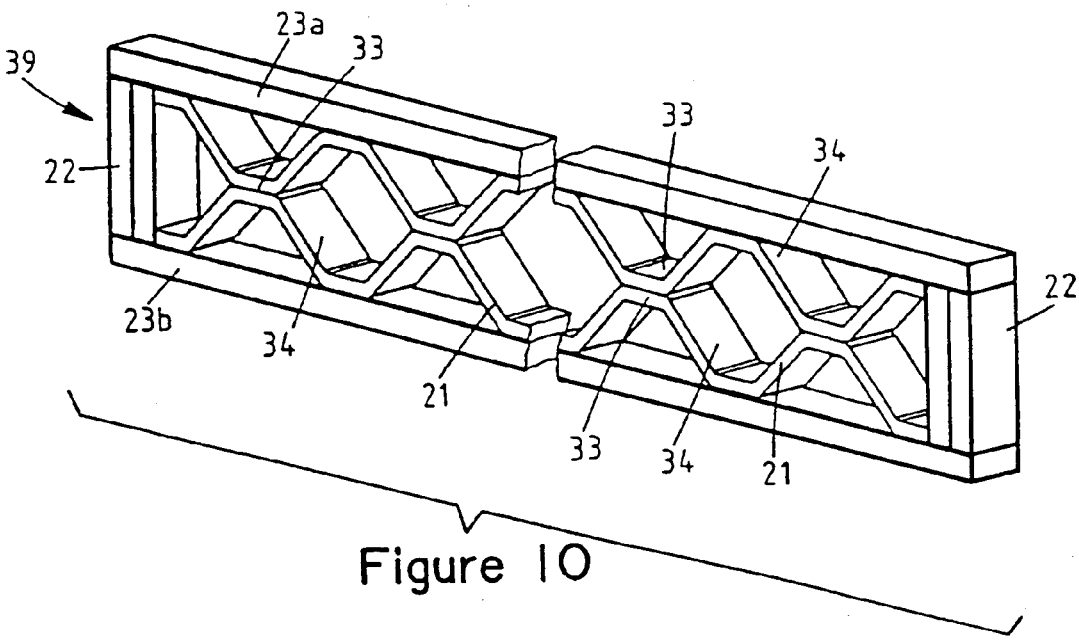
FIG. 10 is a fragmentary isometric view of a composite nominal 2×6 lumber component embodiment of the invention.

To assemble a preferred intermediate bonded assembly 20, bonding adhesive is applied to the interfaces between components, and the components are aligned. For example, adhesive can be applied to the outer surfaces 133*a*, 133*b*, and 133*d* (FIG. 5) of outer zones 33 of one or more web panels 21. Where two or more web panels are utilized, preferably the outer zones 33 are aligned such that the channels 24 are parallel and the outer surfaces of the outer zones 33 coincide, for example as shown in FIG. 10. One or more web 21 panels can be stacked to form the web core, which can be aligned with one or more flange 23 panels and bonded thereto. Optional end blocks 22 can be bonded to the flange panels 23 and web panel(s) 21 at the ends of the web panel(s) 21, parallel to the channels 24. A second flange panel can be aligned with and bonded to the web 21 panel and optional end block 22 beams.

Subsequent to application of the bonding adhesive and alignment of the components, the entire bonded assembly 20 is conveyed into a press, preferably a continuous nip press or a platen press, for a predetermined period of time, and subjected to elevated pressure and/or temperature sufficient to cure and/or dry the adhesive.

To produce a composite lumber article, the bonded assembly 20 is then conveyed to a multiple-arbor saw. The saw cuts the bonded assembly 20 in the direction perpendicular to the channels 24, along the lines 25. The width between the arbors is about equal to the width of the desired composite lumber articles, for example about 1½ inches (about 3.81 cm), the width of a nominal 2×4. Using this method, multiple multi-ply wood composite lumber embodiments of the invention can be produced from a single bonded assembly 20.

Figure 8:
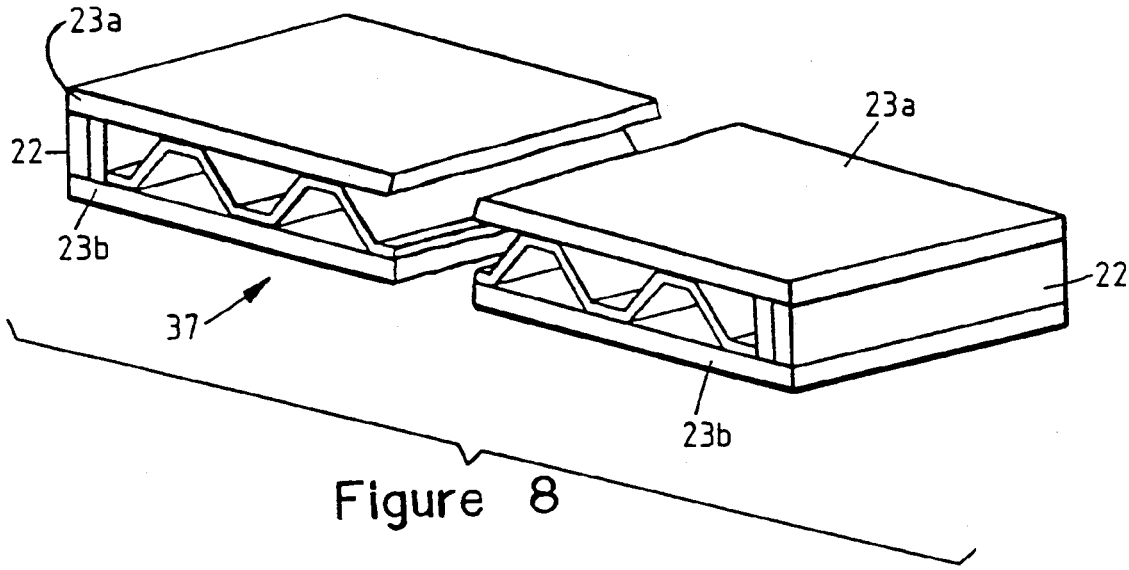
FIG. 8 is a fragmentary isometric view of a composite support post embodiment of the invention.

A support post 37, one example of which is depicted in FIG. 8, can be produced from the same intermediate bonded assembly 20 used for composite lumber by simply cutting a thicker section, for example about 1 foot (about 30.5 cm), from the bonded assembly 20, preferably in the direction parallel to the channels 24; In this manner a support post 37 having a width of about 1 foot (about 30.5 cm) can be produced with the same efficiencies of composite lumber. This is an advantage over known methods in which, for example, 8 conventional 2×4's are glued together to produce a support post with the same dimensions.

Added performance such as coloring and resistance to fire, insects, bacteria, and water can also be achieved by the addition of suitable performance-enhancing additives and/or by the application of suitable specialty coatings to the surfaces of the composite lumber articles of the invention.

Composite lumber embodiments of the invention can be designed to have the same outer dimensions as conventional lumber and modulus of elasticity and moment of inertia sufficient to meet construction requirements for typical applications. However, the invention is also applicable to the production of lumber components having alternative cross sectional dimensions, and in lengths limited only by the size of the equipment used to produce the individual components of the assembly 20.

Furthermore, the invention can also provide composite lumber articles having performance characteristics that differ from their conventional lumber counterparts. For example, conventional 2×6 (nominal) lumber is frequently used in building construction to provide a 5½ inch (about 14 cm) deep space for R-19 insulation between sheathings, but is typically much stronger than necessary to meet building code requirements, thereby increasing the cost of a construction project. A multi-ply wood composite lumber component of the invention nominally measuring 2×6 may have the same cross-sectional dimensions as a conventional 2×6, but can be engineered to specific (e.g., increased or decreased compared to conventional wood lumber) strength requirements. Thus, one advantage of the invention is the ability to provide a building component that meets or exceeds the building code requirements but, among other advantages, uses less starting material, weighs less, and is less expensive to produce than a conventional article, such as a conventional 2×6.

Example of Nominal 2×4 of the Invention

An example of a preferred composite product of the invention (shown in an isometric view in FIG. 9) suitable as a replacement for conventional 2"×4"×8' (nominal) conventional lumber includes one web 21 and two end blocks 22 sandwiched between and bonded with two flanges 23. A preferred composite 2×4 article 38 of the invention is designed to have the same cross-sectional dimensions as conventional 2×4 lumber, namely 1½ inches by 3½ inches (about 38.1 mm by about 88.9 mm), a length of about 8 feet (about 244 cm), and a modulus of elasticity that allows the product to meet construction and safety standards for Housing and Urban Development (HUD) manufactured home construction for Wind Zone 1 construction. However, the invention is also applicable to the production of other multi-ply wood composite replacements for conventional lumber, including actual and nominal 1×3s, 1×4s, 2×3s, 2×6s, 2×8s, 2×10s, 2×12s, 4×4s, 4×6s, and 6×6s, for example, and in lengths limited only by the size of the equipment used to produce the individual components of the assembly 20. For example, FIG. 10 is a perspective view of a multi-ply composite 2×6 article 39 which can serve as a replacement for a conventional nominal 2×6. This embodiment of the invention incorporates two web 21 panels in reflectively symmetrical arrangement, and also bonded at their outer zones 33.

The construction of a preferred 2×4 article 38 of the invention will now be described. A preferred web 21 can be made from strands having a length in a range of about 4½ inches to about 5½ inches (about 11.4 cm to about 14 cm), width in a range of about ¾ inch to about 1 inch (about 19 mm to about 25.4 mm), and thickness in a range of about 0.02 inch to about 0.025 inch (about 0.51 mm to about 0.64 mm). The strands utilized in a preferred web 21 have a pre-pressing moisture content in a range of about 2% to about 9%, preferably in a range of about 4% to about 6%, for example about 5%, based upon weight of the strands.

The mat is produced as described above by combining strands, resin binder, a wax, and other optional additives. A preferred resin binder for the web 21 is a resorcinol resin, preferably added at about 4½ wt. % based upon the weight of the wood strands. Wax preferably is added to the raw material in a range of about 1½ wt. % to about 2 wt. %, for example about 1½ wt. %, based upon the weight of the wood strands.

In a preferred 2×4 embodiment, the mat which will become the web 21 is formed of three layers of raw material including strands, according to the continuous process described above. The strands of the first (bottom) and third (top) layers are oriented in the machine direction (i.e., in the direction perpendicular to channels 24) and comprise about 90% of the total mat weight, divided about equally between the two layers. The strands of the second, or middle, layer are oriented perpendicular to the machine direction (i.e., in the direction parallel to channels 24) and comprise the remainder, about 10% of the total mat weight.

The composite 2×4 articles of the invention preferably are made having lengths of about 81.75 inches (about 2.08 m), about 87.75 inches (about 2.23 m), or about 96 inches (about 2.44 m), to correspond to lengths typically used in construction industries. One type of preferred web 21 for use in the above articles has lengths of about 81.75 inches (about 2.08 m), about 87.75 inches, (about 2.23 m) or about 96 inches (about 2.44 m), respectively. In an alternative web embodiment, the preferred lengths are about 75.75 inches (about 1.92 m), about 81.75 inches (about 2.08 m), or about 90 inches (about 2.29 m), respectively to provide an approximately 3 inch (about 7.6 cm) space at each end for end blocks.

The width of the web panel (and, thus, the mat used to produce the web) preferably is as great as possible in order to maximize the efficiencies of production of multiple lumber components from one bonded assembly 20. For example, in a 4 foot by 8 foot (about 1.22 m by 2.44 m) heated press used to produce composite 2×4 lumber about 8 feet (about 2.44 m) long, the web panel preferably is about 4 feet (about 1.22 m) wide. Most preferably, an 8 foot (about 2.44 m) by 24 foot (about 7.32 m) heated press is used to produce composite 2×4 lumber about 8 feet (about 2.44 m) long, with a web panel preferably about 24 feet (about 7.32 m) wide.

The temperature of the press platens during mat consolidation using a phenolic resin preferably is about 450° F. (about 232° C.). The pressing time depends on the caliper of the finished product and the other factors listed above, but is generally in a preferred range of about 2.5 minutes to about 3 minutes for a preferred web of the invention for use in 2×4 composite lumber applications.

The web panel 21 according to the invention preferably has a specific gravity in a range of about 0.6 to about 0.9 at any location in the panel, most preferably about 0.75. The overall specific gravity of the panel preferably is in a range of about 0.6 to about 0.9, for example 0.75, making it a high density wood composite. The varying die gap preferably allows for the production of a web panel 21 having an at least substantially uniform density throughout its profile. Preferably, the density of the web 21 at an outer zone 33 is at least about 75% of the density of the web 21 at an angled zone 34, more preferably at least about 90%, for example about 95%. Likewise, the density of the web 21 at an upwardly disposed outer zone (e.g., 33*a*) preferably is at least about 75% of the density of the web 21 at a downwardly disposed outer zone (e.g., 33*d*), more preferably at least about 80%, most preferably at least about 90%, for example 95%.

The caliper of the web 21 of the article 38 preferably is in a range of about ¼ inch to about ½ inch (about 6.35 mm to about 12.7 mm). The caliper of the angled zones 34 preferably is greater than that of the upwardly disposed outer zones 33*a*, 33*b*, and 33*c*. The caliper of the downwardly disposed outer zones 33*d*, 33*e*, and 33*f* preferably is at least about equal to that of the angled zones 34. For example, in the article 38 of FIG. 9, the caliper of downwardly disposed outer zones 33*d*, 33*e* and 33*f*, and the angled zones 34 is about 0.375 inch (about 9.52 mm) and the caliper of the upwardly disposed outer zones 33*a*, 33*b* and 33*c* is about 0.340 inch (about 8.64 mm). In another example, the caliper of downwardly disposed outer zones 33*d*, 33*e* and 33*f* is about 0.352 inch (about 8.94 mm), the caliper of upwardly disposed outer zones 33*a*, 33*b* and 33*c* is about 0.3 inch (about 7.62 mm), and the caliper of the angled zones 34 tapers from 0.352 inch to about 0.3 inch between the downwardly disposed and upwardly disposed outer zones, respectively.

The outer zones 33 of the web 21 preferably have a length of about 6 inches (about 15.24 cm) or less, or about 2 inches (about 5.08 cm) or less, for example about 1.1688 inches (about 2.97 cm). The outer zone 33 of the web 21 can be longer than 2 inches in special applications. The draft angle of the web 21 of the article 38 preferably is about 45 degrees.

Table III below summarizes preferred dimensions for a tapered composite lumber web 21 useful as a component of a nominal 2×4, wherein the web 21 has a profile thickness equal to about two inches (5.08 cm), a web segment 36 length equal to about 3.175 inches (8.06 cm), a draft angle β equal to about 45 degrees, an angle γ in the range of about 25 degrees to about 35 degrees, and radii 35*b* and 35*c* each independently established in a range between approximately 0.15 inches (3.81 mm) and approximately 0.35 inches (8.89 mm), for example 0.25 inches (6.35 mm). The caliper of angled zone 34 at three different locations is indicated in FIG. 15 by elements 34*a*, 34*b*, and 34*c*.

TABLE III

Preferred Web Caliper and Radii, Approximate Values*

| Caliper of web 21 at different locations | | | | | Preferred range | Preferred |
|---|---|---|---|---|---|---|
| 33a | 34a | 34b | 34c | 33d | for radius 35a | radius 35a |
| 0.125 | 0.127 | 0.135 | 0.143 | 0.147 | 0.234 to 0.360 | 0.297 |
| (3.18) | (3.23) | (3.43) | (3.63) | (3.73) | (5.94 to 9.14) | (7.54) |
| 0.25 | 0.253 | 0.269 | 0.285 | 0.293 | 0.469 to 0.719 | 0.597 |
| (6.35) | (6.43) | (6.83) | (7.24) | (7.44) | (11.91 to 18.27) | (15.09) |
| 0.375 | 0.380 | 0.404 | 0.428 | 0.440 | 0.703 to 1.079 | 0.891 |
| (9.53) | (9.65) | (10.26) | (10.87) | (11.18) | (17.85 to 27.41) | (22.63) |
| 0.500 | 0.507 | 0.539 | 0.570 | 0.587 | 0.938 to 1.438 | 1.188 |
| (12.7) | (12.88) | (13.69) | (14.48) | (14.91) | (23.83 to 36.53) | (30.18) |
| 0.625 | 0.633 | 0.673 | 0.713 | 0.733 | 1.172 to 1.796 | 1.484 |
| (15.88) | (16.08) | (17.09) | (18.11) | (18.62) | (29.77 to 45.61) | (37.69) |
| 0.750 | 0.760 | 0.808 | 0.855 | 0.880 | 1.406 to 2.156 | 1.781 |
| (19.05) | (19.30) | (20.52) | (21.72) | (22.35) | (35.71 to 54.77) | (45.24) |

*all dimensions in inches (mm)

The flanges 23*a* and 23*b* of the article 38 preferably are OSB, made from the same raw material as the web 21 and oriented with the strands perpendicular to the channels 24 of the web 21 (i.e., parallel with the longitudinal axis of the article 38). The flange 23 preferably has a length of about 8 feet (about 2.43 m). The caliper (thickness) of the flange 23 preferably is in a range of about ⅛ inch to about 1 inch (about 3.18 mm to about 25.4 mm), and more preferably in a range of about ½ inch to about 1 inch (about 1.27 cm to about 2.54 cm), for example about 0.75 inches (about 1.9 cm) in a preferred flange 23 embodiment useful in a nominal 2×4 embodiment of the invention.

Figure 9:
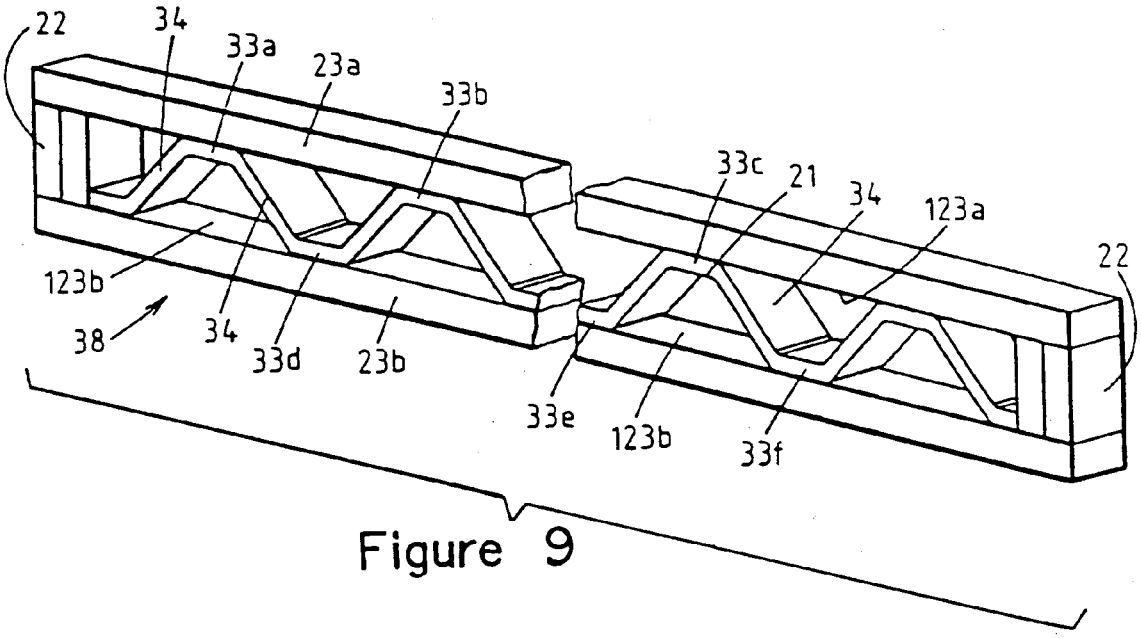
FIG. 9 is a fragmentary isometric view of a composite nominal 2×4 lumber component embodiment of the invention.

In one preferred embodiment of the invention, the end block 22 width (measured in FIG. 1 in the direction parallel to lines 25) preferably is in a range of about 1 inch (about 2.54 cm) to about 5 inches (about 12.7 cm), preferably about 1½ inches (about 3.8 cm), more preferably about 3 inches (about 7.62 cm). An end block 22 can be constructed from the offstock of flange 23 production. For example, an end block with width about 1½ inches (about 3.8 cm) can be achieved by bonding together two segments of ¾ inch (1.9 cm) flange 23 stock or offstock, as shown in FIG. 9, for example. The end block 22 thickness preferably is about 2 inches (about 5.08 cm), about equal to the profile depth of the web 21.

The web panel 21, flange panels 23, and end blocks 22 then are assembled and bonded according to the method described above to form a bonded assembly 20, as shown in FIG. 1. In a preferred 2×4 article of the invention produced according to the description above, the bonding adhesive has a minimum shear strength of about 400 lb/in$^2$ (about 28.1 kg/cm$^2$).

The bonded assembly 20 then is conveyed to a multiple-arbor saw. The saw cuts the bonded assembly in the direction perpendicular to the channels 24 of the web 21 along lines 25 of FIG. 1, as described above.

A composite 2×4 of the example is designed to meet construction specifications for applications in which conventional 2×4s are used as studs. In a preferred 2×4 embodiment, the flange 23 has a minimum modulus of elasticity of about 900,000 lb/in$^2$. For example, in a test method described by Fleetwood Enterprises, Inc., of Riverside, Calif. and HUD standards, a nominal 2×4 is supported at the top and bottom (in contact with the side measuring 1½ inches (3.8 cm)) and an evenly distributed load is applied over the length of the component. To pass a "live load" test, a 2×4 does not break immediately after application of 2½ times the "live load.". To pass a deflection test, the 2×4 must not be displaced at the midpoint more than a maximum allowable deflection value. The live load is determined by the wind load, which is about 15 lb/ft$^2$ (73 kg/m$^2$) multiplied by the length of the lumber component and multiplied by the distance that the studs are spaced apart in a wall. The allowable deflection is determined by the 2×4 length divided by 180. For example, for a 2×4 having length of about 81.75 inches (about 2.08 m) and spaced apart about 16 inches (about 40.64 cm), the live load is about 136 pounds (about 61.7 kg) and the allowable deflection is about 0.45 inch (about 11.43 mm); for a 2×4 having length of about 87.75 inches (about 2.23 m) and spaced apart about 16 inches (about 40.64 cm), the live load is about 146 pounds (about 66.3 kg) and the allowable deflection is about 0.49 inch (about 12.45 mm); and for a 2×4 having length of about 96 inches (about 2.44 m) and spaced apart about 16 inches (about 40.64 cm), the live load is about 160 pounds (about 72.6 kg) and the allowable deflection is about 0.53 inch (about 13.46 mm).

Decking

Figure 11:
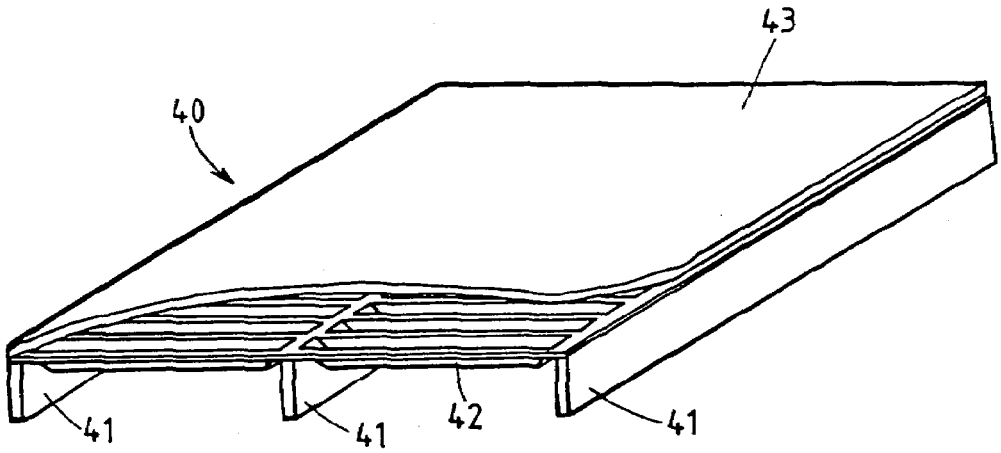
FIG. 11 is a cut-away isometric view of a composite decking component embodiment of the invention shown with conventional joists or trusses.
Figure 12:
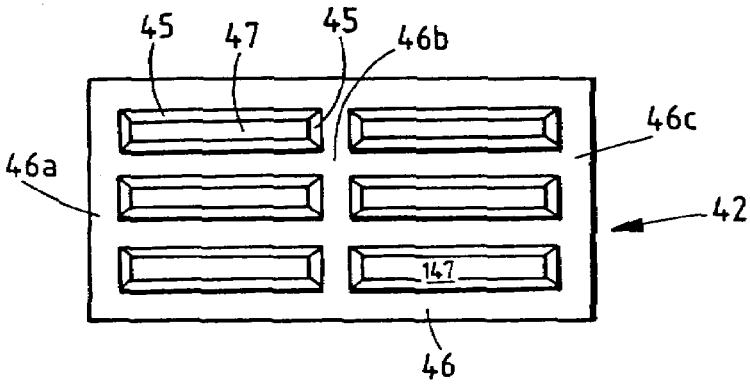
FIG. 12 is a top plan view of a molded element used in a composite decking component embodiment of the invention.

The inventive process can be used to produce an integrated composite decking component product of the invention suitable as a replacement for conventional decking, or engineered with dimensions and strength characteristics for specific applications. FIG. 11 is a cutaway isometric view of a two-ply composite decking component 40, shown with conventional joists or trusses 41. A decking component 40 preferably has a first (lower) molded decking panel 42 bonded to a second (upper) sheathing panel 43. The decking panel is one embodiment of the web panel 21 described above, and thus can have the characteristics and properties of the web panel 21 described above. A preferred decking panel 42 is shown in FIG. 12 in a top plan view, and in FIG. 13 in a side elevation. The portion of the decking panel 42 that is located in the major plane of the panel is referred to as the lattice 46.

The decking panel 42 preferably includes at least one cavity 44, preferably one or more rows and/or one or more columns of cavities 44 (shown from the side in FIG. 13) depending from, contiguous with, and integrally formed with a lattice 46 of a wood composite panel. In one preferred embodiment, shown in FIGS. 11, 12, and 13, the cavities 44 are downwardly disposed right rectangular pyramidal frusta. A frustrum is defined as what remains of a pyramid or cone after truncation along a plane parallel to the base of the pyramid or cone, and frusta is the plural form of frustrum. A cavity 44 of the preferred embodiment has angled (or sloping), spaced-apart side walls 45 extending downwardly from a lattice 46 and terminating in a substantially planar cavity bottom or floor 47, wherein the plane of the cavity floor 47 is generally parallel to the major plane of the lattice 46 of the decking panel 42. The decking component 40 is supported by and/or attached to joist and/or truss elements 41 at parallel, substantially flat strips 46*a*, 46*b*, and 46*c* of the lattice 46 between rows and/or columns of cavities 44 of decking panel 42. The decking component 40 can be attached to joist and/or truss elements 41 by any suitable means, including adhesives and mechanical fasteners, such as staples.

A decking panel 42 of the invention preferably is strand board, wherein the raw material is formed according to the process described above. A mat which becomes the consolidated decking panel 42 preferably is formed of up to three layers of raw material in the continuous process described above, and then cut to size. The strands in a decking panel 42 can be randomly oriented or can be imparted with a specific orientation. Preferable, the strands in a decking panel 42 are randomly oriented. In addition, the decking material optionally can include performance-enhancing materials such as those described above.

In one preferred embodiment, the caliper of the decking panel 42 at the cavity floor 47 and at cavity side walls 45 is greater (thicker) than the caliper of the panel 42 at the lattice 46. In a preferred decking panel 42, the caliper of the cavity floor 47 is at least about equal to the caliper of the cavity side walls 45, and the ratio of the caliper of the lattice 46 to the caliper of the cavity side walls 45 is at least about 0.75, and more preferably in a range of about 0.8 to about 0.9, for example about 0.85.

In another preferred embodiment, the caliper of the decking panel 42 at the cavity floor 47 is less (thinner) than the caliper of the panel at the cavity side walls 45 and lattice 46. In such a decking panel, the caliper of the lattice 46 is at least about equal to the caliper of the cavity side walls 45, and the ratio of the caliper of the cavity floor 47 to the caliper of the cavity side walls 45 is at least about 0.75, and more preferably in a range of about 0.8 to about 0.9, for example about 0.85.

In general, the draft angles formed by the cavity side walls 45 and the lattice 46 of a decking panel 42 are in a range of about 30 degrees to about 60 degrees, preferably in a range of about 35 degrees to about 55 degrees, most preferably in a range of about 40 degrees to about 50 degrees, for example about 45 degrees. In another embodiment of the invention, the draft angle between a side wall 45 and the lattice 46 of a decking panel 42 is greater than 45 degrees. The increased draft angles, especially draft angles greater than about 45 degrees, provide substantial advantages in the decking component 40 of the invention, such as the ability to span greater distances with reduced material cost and increased strength.

The profile thickness of a decking panel 42 (measured by the greatest depth of the decking panel 42, for example, the distance from an upper surface 146 of the lattice 46 to a bottom surface 147 of a cavity floor 47 preferably is in a range of about ¼ inch (about 6.35 mm) to about 8 inches (about 20.32 cm), and more preferably about ¼ inch (about 6.35 mm) to about 4 inches (about 10.16 cm).

The depth of draw is measured as the vertical distance traveled by a side wall 45 between the center lines of a cavity floor 47 and lattice 46. Whereas the depth of draw can be uniform throughout a decking panel 42, this need not be the case. Thus, for example, the cavity floors 47 are preferably, but optionally, in a single plane. The depth of draw preferably is at most about 6 inches (about 15.24 cm), and more preferably in a range of about ¼ inch (about 6.35 mm) to about 3½ inches (about 8.89 cm). In one decking embodiment of the invention, the depth of draw is greater than the caliper of any one of the lattice 46, side wall 45, and cavity floor 47.

The length of a cavity 44, for example the distance between parallel flat zones 46*a* and 46*b* preferably is in a range of about 6 inches (about 15.24 cm) to about 90 inches (about 228.6 cm). The width of a cavity 44, measured in the direction perpendicular to the length, preferably is in a range of about 4 inches (about 10.1 cm) to about 24 inches (about 60.9 cm).

Figure 13:
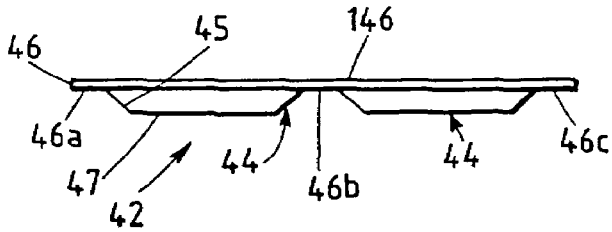
FIG. 13 is a side elevation of a molded element used in a composite decking component embodiment of the invention.

Whereas the lattice 46 shown in FIGS. 11, 12, and 13 is generally flat (planar), in an alternative embodiment the lattice 46 can have contours or other deviations from a planar configuration. For example, a texture can be added to the upper surface 146 of the lattice 46 and, optionally, to the matching surface of the sheathing 43 to provide improved bonding, as described with respect to composite lumber above. A texture also can be added to the lower surface of the lattice 46 (i.e., the surface opposite the upper surface 146) and, optionally, to the matching surface of a joist and/or truss 41 to provide improved bonding, as described with respect to composite lumber above.

In a preferred embodiment of the invention, a consolidated decking panel 42 is bonded with a sheathing panel 43 to form the decking component 40 shown in FIG. 11. In general, the sheathing 43 of a decking component 40 of the invention can be made from any material. The sheathing 43 contributes to the deflection resistance of a composite decking component 40. Thus, the sheathing 43 preferably is made from a material that, in combination with the decking panel 42, provides the desired deflection resistance for a particular application. In one preferred embodiment of the invention, the sheathing 43 is strand board, made from the same raw material as the decking panel 42. In another preferred embodiment, the sheathing 43 is particleboard.

A sheathing 43 of the composite decking component 40 preferably is generally planar with a uniform cross-sectional dimension. However, it is to be understood that the invention is also applicable to the use of other sheathing configurations.

Preferably a sheathing 43 has a length and width about equal to the length and width of a corresponding decking panel 42 in the decking component 40.

Floor Components

Figure 14:
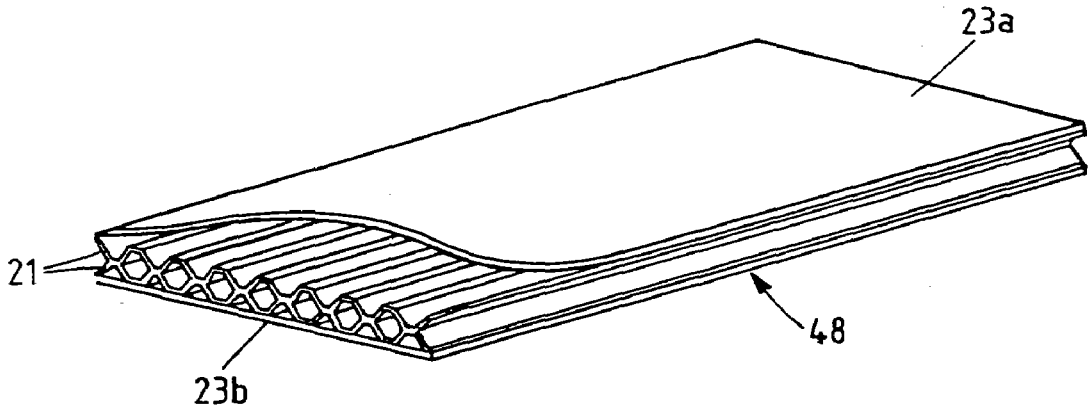
FIG. 14 is a cut-away isometric view of a flooring component embodiment of the invention.

The inventive process can be used to produce an integrated floor component product of the invention suitable as a replacement for conventional joist and decking flooring, or engineered with dimensions and strength characteristics for specific applications. FIG. 14 is a cutaway isometric view of a four-ply or four-layer composite floor component 48. The floor component 48 preferably is made by the same method used to produce the bonded assembly 20 of the composite lumber embodiments, optionally without end blocks.

Referring to FIG. 14, a floor component 48 produced by the method of the invention preferably has two web 21 panels bonded to and sandwiched between two flange panels 23*a* and 23*b*. This floor component 48 of the invention provides significant advantages over the prior art, including reduced cost and reduced labor needs for installation.

Wall Components

The inventive process can be used to produce an integrated wall component product of the invention suitable as a replacement for conventional stud and sheathing walls, or engineered with dimensions and strength characteristics for specific applications.

The wall component preferably is made by the same method used to produce the bonded assembly 20 of the composite lumber embodiments. The web 21 of a wall component preferably has a much lower frequency of web segment 36 repeat. In addition, the wall component preferably has one web 21 with a profile depth of about 5½ inches (about 14 cm) to accommodate R-19 insulation in the channels 24 between flanges 23.

Building components made according to the invention such as lumber components, decking components, floor components, walls, posts and framing members exhibit many improved attributes. First, the invention provides consistency in sizing accuracy of building components, both at the time of construction and over the lifespan of the component and structures built therewith. The building components of the invention also require less material input than their conventional lumber and sheathing counterparts. The building components of the invention can weigh less than their conventional lumber and sheathing counterparts. Because the building components of the invention weigh less than their conventional lumber and sheathing counterparts, they can be shipped in larger sizes. Moreover, because the building components of the invention are dimensionally consistent and can be shipped in larger sizes, less labor is required to assemble the components in construction of a building. In addition, the invention can provide a product with increased surface friction to facilitate installation and usage.

Larger distances can be spanned while using fewer supporting members because the building components of the invention can be engineered to be stronger than their conventional lumber counterparts. The composite lumber embodiments of the invention are able to provide built-in voids suitable to accommodate wiring and piping, which eliminates the labor involved in drilling conventional lumber for the same purpose. Moreover, the multi-ply building components of the invention are able to provide built-in voids which increase the thermal and acoustic insulating efficiency of the components. The invention also provides for the ability to engineer building components with built-in properties such as custom pigmentation and resistance to fire, insects, water, UV radiation, and bacteria. The building components of the invention also are environmentally friendly because they allow for more thorough usage of timber, allow for the usage of lower-quality timber, and can be ground up and easily disposed of or reused. Finally, the invention provides for great efficiencies of production whereby many pieces of composite lumber or fully-assembled flooring systems can be produced at once in assembly-line fashion and whereby many of the same operations can be used to produce different building components such as walls, posts, and composite lumber.

The foregoing detailed description is given for clearness of understanding only, and no unnecessary limitations should be understood therefrom, as modifications within the scope of the invention wilt be apparent to those skilled in the art.

What is claimed is:

1. A method of producing a composite building component, said method comprising the steps of:

(a) placing a first mat comprising a first wood-based material in a die set comprising an upper die and a lower die, and closing the dies to establish an upper outer zone die gap portion lying in a first plane, a lower outer zone die gap portion lying in a second plane spaced apart from and below the first plane, and an angled zone die gap portion disposed between, contiguous with, and junctioned to said upper and lower outer zone die gap portions, wherein the upper outer zone die gap portion has a first die gap caliper that is less than second and third die gap calipers of the lower outer zone die gap portion and the angled zone die gap portion, respectively;

(b) consolidating the first mat in the die set to form a first molded composite web having a first profile, the first profile comprising first outer zone having a first thickness consolidated in the upper outer zone die gap portion, a second outer zone having a second thickness consolidated in the lower outer zone die gap portion, and an angled zone having a third thickness consolidated in the angled zone die gap portion and disposed between, contiguous with, and junctioned to said first and second outer zones;

(c) placing a second mat comprising a second wood-based material in the die set;

(d) consolidating the second mat in the die set to form a second molded composite web having a second profile identical to the first profile; and (e) securing opposite end portions of the first and second molded composite webs to first and second end block beams, respectively, to establish a composite building component, wherein the first molded composite web opposes the second molded composite web in a reflectively symmetrical arrangement.

2. The method according to claim 1 wherein the second die gap caliper of said lower outer zone die gap portion is at least about equal to the third die gap caliper of the angled zone die gap portion.

3. The method according to claim 1 wherein the ratio of the first die gap caliper to the second and third die gap calipers is in a range of about 0.8 to 0.9.

4. The method according to claim 1 wherein the surface area of the first molded composite web is up to about 75% greater than the surface area of the first mat.

5. The method according to claim 4 wherein the surface area of the first molded composite web is about 15% to about 25% greater than the surface area of the first mat.

6. The method according to claim 1 further comprising:

(f) joining a first flange to an outer surface of the first outer zone of the first molded composite web;

(g) joining a second flange to an outer surface of the first outer zone of the second molded composite web; and (h) dividing the composite building component in a direction perpendicular to a direction in which the first and second outer zones extend.

7. The method according to claim 1, wherein the angled zone possesses a non-planar configuration.

8. The method according to claim 7, wherein the angled zone possesses a combination of planar and contoured portions.

9. The method according to claim 1, wherein the third caliper tapers from the lower outer zone die gap portion to the upper outer zone die gap portion.

10. The method according to claim 1, wherein the first and second webs have substantially uniform densities throughout.

11. The method according to claim 1, wherein said securing comprises adhesively bonding opposite end portions of the first and second molded composite webs to first and second end block beams, respectively.

12. The method according to claim 1, further comprising:

(f) pressing the composite building component.

13. The method according to claim 1, wherein opposing outer zones of the first and second molded composite web contact one another.

14. The method according to claim 3, wherein said securing comprises adhesively bonding opposite end portions of the first and second molded composite webs to first and second end block beams, respectively.

15. The method according to claim 3, further comprising:

(f) pressing the composite building component.

16. The method according to claim 4, wherein alternating outer zones of the first molded composite web contact corresponding alternating outer zones of the second molded composite web.

17. A method of producing a composite building component, said method comprising the steps of:

(a) placing a first mat comprising a first wood-based material in a die set comprising an upper die and a lower die, and closing the dies to establish an alternating pattern of upper outer zone die gap portions lying in a first plane and lower outer zone die gap portions lying in a second plane spaced apart from and below the first plane, and angled zone die gap portions disposed between, contiguous with, and junctioned to said alternating upper and lower outer zone die gap portions wherein the upper outer zone die gap portion has a first die gap caliper that is less than second and third die gap calipers of the lower outer zone die gap portion and the angled zone die gap portion respectively, (b) consolidating the first mat in the die set to form a first molded composite web having a first profile, the first profile comprising first outer zones having a first thickness consolidated in the upper outer zone die gap portions, second outer zones alternating with the first outer zones and having a second thickness consolidated in the lower outer zone die gap portion, and angled zones having a third thickness consolidated in the angled zone die gap portions and disposed between, contiguous with, and junctioned to said first and second outer zones;

(c) placing a second mat comprising a second wood-based material in the die set;

(d) consolidating the second mat in the die set to form a second molded composite web having a second profile identical to the first profile; and (e) securing opposite end portions of the first and second molded composite webs to first and second end block beams, respectively, to establish a composite building component, wherein the first molded composite web opposes the second molded composite web in a reflectively symmetrical arrangement.

18. The method according to claim 17 wherein the second die gap caliper of said lower outer zone die gap portions is at least about equal to the third die gap caliper of the angled zone die gap portions.

19. The method according to claim 17 wherein the ratio of the first die B gap caliper to the second and third die gap calipers is in a range of about 0.8 to 0.9.

20. The method according to claim 17 wherein the surface area of the first molded composite web is up to about 75% greater than the surface area of the first mat.

21. The method according to claim 20 wherein the surface area of the first molded composite web is about 15% to about 25% greater than the surface area of the first mat.

22. The method according to claim 17 wherein said molded composite webs each has at least one channel defined by said alternating upper and lower outer zones, and said angled zones, and wherein said method further comprises:

(f) joining a first flange to an outer surface of the first outer zones of the first molded composite web;

(g) joining a second flange to an outer surface of the first outer zones of the second molded composite web; and (h) dividing the composite building component in a direction perpendicular to the channel.

23. The method according to claim 17, wherein the angled zones of the molded composite webs possess a non-planar configuration.

24. The method according to claim 22, wherein the angled zones possess a combination of planar and contoured portions.

25. The method according to claim 13, wherein the third caliper tapers from the lower outer zone die gap portions to the upper outer zone die gap portions.

26. The method according to claim 13, wherein the first and second webs have substantially uniform densities throughout.

* * * * *

UNITED STATES PATENT AND TRADEMARK OFFICE

CERTIFICATE OF CORRECTION

PATENT NO. : 7,255,765 B2
APPLICATION NO. : 10/913525
DATED : August 14, 2007
INVENTOR(S) : Mark A. Ruggie et al.

It is certified that error appears in the above-identified patent and that said Letters Patent is hereby corrected as shown below:

In the Specification

Column 1, lines 13-14, after "35 U.S.C. § 120" and before "." insert --, and 35 U.S.C. § 119(e) with respect to the provisional patent application--.

Signed and Sealed this
Twentieth Day of May, 2014

Michelle K. Lee

Michelle K. Lee
*Deputy Director of the United States Patent and Trademark Office*